US009783877B2

(12) United States Patent
Hofmann et al.

(10) Patent No.: US 9,783,877 B2
(45) Date of Patent: Oct. 10, 2017

(54) SYSTEMS AND METHODS FOR IMPLEMENTING BULK METALLIC GLASS-BASED MACROSCALE COMPLIANT MECHANISMS

(71) Applicant: California Institute of Technology, Pasadena, CA (US)

(72) Inventors: Douglas C. Hofmann, Pasadena, CA (US); Gregory Agnes, Valencia, CA (US)

(73) Assignee: California Institute of Technology, Pasadena, CA (US)

( * ) Notice: Subject to any disclaimer, the term of this patent is extended or adjusted under 35 U.S.C. 154(b) by 414 days.

(21) Appl. No.: 13/942,932

(22) Filed: Jul. 16, 2013

(65) Prior Publication Data

US 2014/0020794 A1 Jan. 23, 2014

Related U.S. Application Data

(60) Provisional application No. 61/672,656, filed on Jul. 17, 2012.

(51) Int. Cl.

| | |
|---|---|
| ***C22C 45/10*** | (2006.01) |
| ***C22C 45/00*** | (2006.01) |
| ***C22C 45/06*** | (2006.01) |
| ***B21J 5/02*** | (2006.01) |
| ***C22C 1/00*** | (2006.01) |

(Continued)

(52) U.S. Cl.

CPC ..... *C22C 45/00* (2013.01); *B21J 1/006* (2013.01); *B21J 5/027* (2013.01); *C22C 1/002* (2013.01); *C22C 45/06* (2013.01); *C22C 45/10* (2013.01); *B26D 2001/002* (2013.01)

(58) Field of Classification Search

None

See application file for complete search history.

(56) References Cited

U.S. PATENT DOCUMENTS

| | | | |
|---|---|---|---|
| 3,529,457 | A | 9/1970 | Bowers |
| 3,986,412 | A | 10/1976 | Farley et al. |

(Continued)

FOREIGN PATENT DOCUMENTS

| | | | |
|---|---|---|---|
| CN | 102563006 | A | 7/2012 |
| DE | 20100062089 | A1 | 5/2012 |

(Continued)

OTHER PUBLICATIONS

US 9,285,027, 03/2016, Hofmann et al. (withdrawn)

(Continued)

*Primary Examiner* — George Wyszomierski

(74) *Attorney, Agent, or Firm* — KPPB LLP

(57) ABSTRACT

Systems and methods in accordance with embodiments of the invention implement bulk metallic glass-based macroscale compliant mechanisms. In one embodiment, a bulk metallic glass-based macroscale compliant mechanism includes: a flexible member that is strained during the normal operation of the compliant mechanism; where the flexible member has a thickness of 0.5 mm; where the flexible member comprises a bulk metallic glass-based material; and where the bulk metallic glass-based material can survive a fatigue test that includes 1000 cycles under a bending loading mode at an applied stress to ultimate strength ratio of 0.25.

23 Claims, 21 Drawing Sheets

(51) Int. Cl.
*B21J 1/00* (2006.01)
*B26D 1/00* (2006.01)

(56) References Cited

U.S. PATENT DOCUMENTS

| | | | |
|---|---|---|---|
| RE29,989 | E | 5/1979 | Polk |
| 4,173,393 | A | 11/1979 | Maurer |
| 4,202,404 | A | 5/1980 | Carlson |
| 4,711,795 | A | 12/1987 | Takeuchi et al. |
| 4,810,314 | A | 3/1989 | Henderson et al. |
| 4,812,150 | A | 3/1989 | Scott |
| 4,823,638 | A | 4/1989 | Ishikawa et al. |
| 4,851,296 | A | 7/1989 | Tenhover et al. |
| 4,883,632 | A | 11/1989 | Goto et al. |
| 5,168,918 | A | 12/1992 | Okuda et al. |
| 5,288,344 | A | 2/1994 | Peker et al. |
| 5,310,432 | A | 5/1994 | Yamanaka et al. |
| 5,772,803 | A | 6/1998 | Peker et al. |
| 6,162,130 | A | 12/2000 | Masumoto et al. |
| 6,273,322 | B1 | 8/2001 | Yamamoto et al. |
| 6,620,264 | B2 | 9/2003 | Kundig et al. |
| 6,652,679 | B1 | 11/2003 | Inoue et al. |
| 6,771,490 | B2 | 8/2004 | Peker et al. |
| 6,843,496 | B2 | 1/2005 | Peker et al. |
| 6,887,586 | B2 | 5/2005 | Peker et al. |
| 7,052,561 | B2 | 5/2006 | Lu et al. |
| 7,073,560 | B2 | 7/2006 | Kang et al. |
| 7,075,209 | B2 | 7/2006 | Howell et al. |
| 7,357,731 | B2 | 4/2008 | Johnson et al. |
| 7,360,419 | B2 | 4/2008 | French et al. |
| 7,497,981 | B2 | 3/2009 | Graham et al. |
| 7,500,987 | B2 | 3/2009 | Bassler et al. |
| 7,552,664 | B2 | 6/2009 | Bulatowicz |
| 7,862,323 | B2 | 1/2011 | Micarelli |
| 7,896,982 | B2 | 3/2011 | Johnson et al. |
| 8,400,721 | B2 | 3/2013 | Bertele et al. |
| 8,485,245 | B1 | 7/2013 | Prest et al. |
| 8,596,106 | B2 | 12/2013 | Tang et al. |
| 8,613,815 | B2 | 12/2013 | Johnson et al. |
| 8,986,469 | B2 | 3/2015 | Vecchio et al. |
| 9,057,120 | B2 | 6/2015 | Pham et al. |
| 9,328,813 | B2 | 5/2016 | Hofmann et al. |
| 9,610,650 | B2 | 4/2017 | Hofmann et al. |
| 2002/0053375 | A1 | 5/2002 | Hays et al. |
| 2002/0100573 | A1 | 8/2002 | Inoue et al. |
| 2002/0184766 | A1 | 12/2002 | Kobayashi et al. |
| 2003/0062811 | A1 | 4/2003 | Peker et al. |
| 2004/0103536 | A1 | 6/2004 | Kobayashi et al. |
| 2004/0103537 | A1 | 6/2004 | Kobayashi et al. |
| 2004/0154701 | A1 | 8/2004 | Lu et al. |
| 2005/0034792 | A1 | 2/2005 | Lu et al. |
| 2005/0127139 | A1 | 6/2005 | Slattery et al. |
| 2006/0156785 | A1 | 7/2006 | Mankame |
| 2007/0034304 | A1 | 2/2007 | Inoue et al. |
| 2007/0226979 | A1* | 10/2007 | Paton ..... C22C 45/00 29/90.7 |
| 2009/0114317 | A1 | 5/2009 | Collier et al. |
| 2009/0194205 | A1 | 8/2009 | Loffler et al. |
| 2010/0313704 | A1 | 12/2010 | Wang et al. |
| 2011/0048587 | A1 | 3/2011 | Vecchio et al. |
| 2011/0302783 | A1 | 12/2011 | Nagata et al. |
| 2012/0067100 | A1 | 3/2012 | Stefansson et al. |
| 2012/0073710 | A1 | 3/2012 | Kim et al. |
| 2013/0112321 | A1 | 5/2013 | Poole et al. |
| 2013/0133787 | A1 | 5/2013 | Kim |
| 2013/0139964 | A1 | 6/2013 | Hofmann et al. |
| 2013/0309121 | A1 | 11/2013 | Prest et al. |
| 2013/0333814 | A1 | 12/2013 | Fleury et al. |
| 2014/0020794 | A1 | 1/2014 | Hofmann et al. |
| 2014/0083640 | A1 | 3/2014 | Waniuk et al. |
| 2014/0093674 | A1 | 4/2014 | Hofmann et al. |
| 2014/0202595 | A1 | 7/2014 | Hofmann |
| 2014/0213384 | A1 | 7/2014 | Johnson et al. |
| 2014/0224050 | A1 | 8/2014 | Hofmann et al. |
| 2014/0227125 | A1 | 8/2014 | Hofmann |
| 2014/0246809 | A1 | 9/2014 | Hofmann |
| 2014/0312098 | A1 | 10/2014 | Hofmann et al. |
| 2014/0342179 | A1 | 11/2014 | Hofmann et al. |
| 2015/0047463 | A1 | 2/2015 | Hofmann et al. |
| 2015/0068648 | A1 | 3/2015 | Schroers et al. |
| 2015/0075744 | A1 | 3/2015 | Hofmann et al. |
| 2015/0314566 | A1 | 11/2015 | Mattlin et al. |
| 2016/0186850 | A1 | 6/2016 | Hofmann et al. |
| 2016/0258522 | A1 | 9/2016 | Hofmann et al. |
| 2017/0121799 | A1 | 5/2017 | Hofmann et al. |

FOREIGN PATENT DOCUMENTS

| | | | |
|---|---|---|---|
| EP | 0127366 | A1 | 5/1984 |
| EP | 1063312 | A1 | 12/2000 |
| EP | 1138798 | A1 | 10/2001 |
| EP | 1696153 | A1 | 8/2006 |
| EP | 1404884 | B1 | 7/2007 |
| EP | 1944138 | A2 | 7/2008 |
| JP | 61276762 | A | 12/1986 |
| JP | 2002045960 | A | 2/2002 |
| JP | 2004353053 | A | 12/2004 |
| WO | 2007038882 | A1 | 4/2007 |
| WO | 2011159596 | A1 | 12/2011 |
| WO | 2014004704 | A1 | 1/2014 |
| WO | 2014058498 | A3 | 4/2014 |
| WO | 2015042437 | A1 | 3/2015 |
| WO | 2015156797 | A1 | 10/2015 |

OTHER PUBLICATIONS

International Search Report and Written Opinion for International Application PCT/US2013/050614, Search Completed May 7, 2014, Mailed May 7, 2014, 12 pgs.

International Search Report and Written Opinion for International Application PCT/US2013/047950, completed Oct. 8, 2013, 9 pgs.

Kim et al., "Production of Ni65Cr15P16B4 Metallic Glass-Coated Bipolar Plate for Fuel Cell by High Velocity Oxy-Fuel (HVOF) Spray Coating Method", The Japan Institute of Metals, Materials Transactions, vol. 51, No. 9 (2010) pp. 1609-1613.

Kobayashi et al. "Property of Ni-Based Metallic Glass Coating Produced by Gas Tunnel Type Plasma Spraying", International Plasma Chemistry Society, ISPC 20, 234, Philadelphia, USA; Retrieved from: http://www.ispc-conference.org/ispcproc/ispc20/234.pdf.

Kobayashi et al., "Fe-based metallic glass coatings produced by smart plasma spraying process", Materials Science and Engineering, 2008, vol. B148, pp. 110-113.

Kobayashi et al., "Mechanical property of Fe-base metallic glass coating formed by gas tunnel type plasma spraying", ScienceDirect, Surface & Coatings Technology (2007), 6 pgs.

Kong et al., "Effect of Flash Temperature on Tribological Properties of Bulk Metallic Glasses", Tribol. Lett., 2009, vol. 35, pp. 151-158.

Kumar et al., "Bulk Metallic Glass: The Smaller the Better", Advanced Materials, 2001, vol. 23, pp. 461-476.

Kwon et al., "Wear behavior of Fe-based bulk metallic glass composites", Journal of Alloys and Compounds, 2011, vol. 509S, pp. S105-S108.

Launey et al., "Solution to the problem of the poor cyclic fatigue resistance of bulk metallic glasses", PNAS Early Edition, pp. 1-6.

Li et al., "Wear behavior of bulk Zr41Ti14Cu12.5Ni10Be22.5 metallic glasses", J. Mater. Res., Aug. 2002, vol. 17, No. 8, pp. 1877-1880.

Lillo et al. , "Microstructure, Processing, Performance Relationships for High Temperature Coatings", U.S. Department of Energy, Office of Fossil Energy, under DOE Idaho Operations Office, Contract DE-AC07-05ID14517; 22nd Annual Conference on Fossil Energy Materials, Pittsburgh, U.S., 8 pgs.

List et al. , "Impact Conditions for Cold Spraying of Hard Metallic Glasses", Journal of Thermal Spray Technology, Jun. 2012, vol. 21, No. 3-4, pp. 531-540.

Liu, "Microstructure and properties of Fe-based amorphous metallic coating produced by high velocity axial plasma spraying", Science Direct, Journal of Alloys and Compounds 484 (2009) pp. 300-307.

(56) References Cited

OTHER PUBLICATIONS

Liu et al., "Influence of Heat Treatment on Microstructure and Sliding Wear of Thermally Sprayed Fe-Based Metallic Glass coatings", Tribol. Lett., 2012, vol. 46, pp. 131-138.
Liu et al., "Metallic glass coating on metals plate by adjusted explosive welding technique", Applied Surface Science, 2009, vol. 255, pp. 9343-9347.
Liu et al., "Sliding Tribological Characteristics of a Zr-based Bulk Metallic Glass Near the Glass Transition Temperature", Tribol. Lett. 2009, vol. 33, pp. 205-210.
Liu et al., "Wear behavior of a Zr-based bulk metallic glass and its composites", Journal of Alloys and Compounds, 2010, vol. 503, pp. 138-144.
Lupo! et al. "Deposition of metallic coatings on polymer surfaces using cold spray", Science Direct, Surface & Coatings Technology 205 (2010) pp. 2167-2173.
Ma et al., "Wear resistance of Zr-based bulk metallic glass applied in bearing rollers", Materials Science and Engineering, 2004, vol. A386, pp. 326-330.
Maddala et al., "Effect of notch toughness and hardness on sliking wear of Cu50Hf41.5A18.5 bulk metallic glass", Scripta Materialia, 2011, vol. 65, pp. 630-633.
Ni, "High performance amorphous steel coating prepared by HVOF thermal spraying", Journal of Alloys and Compounds 467 (2009) pp. 163-167.
Parlar et al., "Sliding tribological characteristics of Zr-based bulk metallic glass", Intermetallics, 2008, vol. 16, pp. 34-41.
Pauly et al., "Modeling deformation behavior of Cu—Zr—Al bulk metallic glass matrix composites", Applied Physics Letters, 2009, vol. 95, pp. 101906-1-101906-3.
Ponnambalam et al., "Fe-based bulk metallic glasses with diameter thickness larger than one centimeter", J Mater Res, 2004, vol. 19; pp. 1320-1323.
Porter et al., "Incorporation of Amorphous Metals into MEMS for High Performance and Reliability", Rockwell Scientific Company, Final Report, Nov. 2003, 41 pgs.
Prakash et al., "Sliding wear behavior of some Fe-, Co-and Ni-based metallic glasses during rubbing against bearing steel", Tribology Letters, 2000, vol. 8, pp. 153-160.
Ramamurty et al., "Hardness and plastic deformation in a bulk metallic glass", Acta Materialia, 2005, vol. 53, pp. 705-717.
Revesz, A. et al. , "Microstructure and morphology of Cu—Zr—Ti coatings by thermal spray and treated by surface mechanical attrition", ScienceDirect, Journal of Alloys and Compounds 509S (2011) S482-S485.
Rigney et al., "The Evolution of Tribomaterial During Sliding: A Brief Introduction", Tribol. Lett, 2010, vol. 39, pp. 3-7.
Roberts et al., "Cryogenic Charpy impact testing of metallic glass matrix composites", Scripta Materialia, 2011, 4 pgs.
Schuh et al., "A survey of instrumented indentation studies on metallic glasses", J. Mater. Res., Jan. 2004, vol. 19, No. 1, pp. 46-57.
Segu et al., "Dry Sliding Tribological Properties of Fe-Based Bulk Metallic Glass", Tribol. Lett., 2012, vol. 47, pp. 131-138.
Shen et al., "Exceptionally high glass-forming ability of an FeCoCrMoCBY alloy", Applied Physics, 2005, vol. 86, pp. 151907-1-151907-3.
Sundaram et al., "Mesoscale Folding, Instability, and Disruption of Laminar Flow in Metal Surfaces", Physical Review Letters, Sep. 7, 2012, vol. 109, pp. 106001-1-106001-5.
Tam et al., "Abrasion resistance of Cu based bulk metallic glasses", Journal of Non-Crystalline Solids, 2004, vol. 347, pp. 268-272.
Tam et al., "Abrasive wear of Cu60Zr30Ti10 bulk metallic glass", Materials Science and Engineering, 2004, vol. A384 pp. 138-142.
Tao et al., "Effect of rotational sliding velocity on surface friction and wear behavior in Zr-based bulk metallic glass", Journal of Alloys and Compounds, 2010, vol. 492, pp. L36-L39.
Tao et al., "Influence of isothermal annealing on the micro-hardness and friction property in CuZrAl bulk metallic glass", Advanced Materials Research, 2011, vols. 146-147, pp. 615-618.
Tobler et al., "Cryogenic Tensile, Fatigue, and Fracture Parameters for a Solution-Annealed 18 Percent Nickel Maraging Steel", Journal of Engineering Materials and Technology, Apr. 1978, vol. 100, pp. 189-194.
Wang et al., "Progress in studying the fatigue behavior of Zr-based bulk-metallic glasses and their composites", Intermetallics, 2009, vol. 17, pp. 579-590.
Wagner, "Mechanical Behavior of 18 Ni 200 Grade Maraging Steel at Cyrogenic Temperatures", J Aircraft, Oct. 1986, vol. 23, No. 10, pp. 744-749.
Wikipedia, "Harmonic Drive", printed Feb. 20, 2014, 4 pgs.
Wu et al., "Bulk Metallic Glass Composites with Transformation-Mediated Work-Hardening and Ductility", Adv. Mater., 2010, vol. 22, pp. 2770-2773.
Wu et al., "Effects of environment on the sliding tribological behaviors of Zr-based bulk metallic glass", Intermetallics, 2012, vol. 25, 115-125.
Yin et al. "Microstructure and mechanical properties of a spray-formed Ti-based metallic glass former alloy", ScienceDirect, Journal of Alloys and Compounds 512 (2012) 241-245.
Zachrisson et al., "Effect of Processing on Charpy impact toughness of metallic glass matrix composites", J. Mater. Res., May 28, 2011, vol. 26, No. 10, pp. 1260-1268.
Zhang et al., "Abrasive and corrosive behaviors of Cu—Zr—Al—Ag—Nb bulk metallic glasses", Journal of Physics: Conference Series, 2009, vol. 144, pp. 1-4
Zhang et al., "Robust hydrophobic Fe-based amorphous coating by thermal spraying", Appl. Phys. Lett., 2012, vol. 101, pp. 121603-1-121603-4.
Zhang et al., "Wear behavior of a series of Zr-based bulk metallic glasses", Materials Science and Engineering, 2008, vol. A475, pp. 124-127.
Zhou et al., "Microstructure and Electrochemical Behavior of Fe-Based Amorphous Metallic Coatings Fabricated by Atmospheric Plasma Spraying", Journal of Thermal Spray Technology, Jan. 2011, vol. 20, No. 1-2, pp. 344-350.
Zhuo, "Spray formed Al-based amorphous matrix nanocomposite plate", ScienceDirect, Journal of Alloys and Compounds 509 (2011) L169-L173.
Abdeljawad, F. et al., Physical Review Letters, vol. 105, 205503, Sep. 17, 2010.
Cheng, J. L. et al., Intermetallics, vol. 18, Issue 12, Sep. 24, 2010, pp. 2425-2430.
Fan, C. et al., Applied Physics Letters, vol. 81, Issue 6, Aug. 5, 2002.
Ha, D. J. et al., Materials Science and Engineering: A, vol. 552, May 28, 2012, pp. 404-409.
Harmon, John S. et al., Physical Review Letters, vol. 99, 135502, Sep. 28, 2007.
Hays, C. C. et al., Physical Review Letters, vol. 84, 2901, Mar. 27, 2000.
Hofmann, D. C. et al., Proceedings of the National Academy of Science, vol. 105, Dec. 23, 2008, pp. 20136-20140.
Hofmann, D. C. et al., Material Science Forum, vol. 633-634, 2010, pp. 657-663.
Huang, Y. L. et al., Scripta Materialia, vol. 53, Mar. 29, 2005, pp. 93-97.
Kim, C. P. et al., Scripta Materialia, vol. 65, May 3, 2011, pp. 304-307.
Kuhn, U. et al. Materials Science and Engineering: A, vols. 375-377, 2004, pp. 322-326.
Kuhn, U. et al., Applied Physics Letters, vol. 80, No. 14, Apr. 8, 2002.
Launey, M. E. et al., Applied Physics Letters, vol. 94, 241910, 2009.
Lee, M. L. et al., Acta Materialia, vol. 52, Issue 14, Jun. 17, 2004, pp. 4121-4131.
Narayan, R. L. et al., Scripta Materialia, vol. 63, Issue 7, Jun. 9, 2010, pp. 768-771.
Oh, Y. S. et al., Acta Materialia, vol. 59, Issue 19, Sep. 23, 2011, pp. 7277-7286.
Pauly, S. et al., Nature Materials, vol. 9, Issue 6, May 16, 2010, pp. 473-477.
Qiao, J. W. et al., Materials Science and Engineering: A, vol. 527, Issues 29-30, Aug. 20, 2010, pp. 7752-7756.

(56) References Cited

OTHER PUBLICATIONS

Singer, I. L. et al., Wear, vol. 195, Issues 1-2, Jul. 1996, pp. 7-20.
Szuecs, F. et al., Acta Materialia, vol. 49, Issue 9, Feb. 2001, pp. 1507-1513.
Tan, H. et al., Intermetallics, vol. 10, Issues 11-12, Nov. 2002, pp. 1203-1205.
Wu, Hong et al., Transactions of Nonferrous Metals Society of China, vol. 22, Issue 3, Jan. 2012, pp. 585-589.
Zenebe et al., Tribology Letters, vol. 47, Issue 1, Apr. 28,2012, pp. 131-138.
Zhu, Z. et al., Scripta Materialia, vol. 62, Issue 5, Nov. 18, 2009, pp. 278-281.
Fu et al., "Sliding behavior of metallic glass Part I. Experimental investigations", Wear, 2001, vol. 250, pp. 409-419.
Kozachkov et al., "Effect of cooling rate on the volume fraction of B2 phases in a CuZrAlCo metallic glass matrix composite", Intermetallics, 2013, vol. 39, pp. 89-93.
International Preliminary Report on Patentability for International Application PCT/US2013/047950, Report completed Dec. 31, 2014, Mailed Jan. 8, 2015, 7 Pgs.
International Preliminary Report on Patentability for International Application PCT/US2013/050614, report Issued Jan. 20, 2015, Mailed Jan. 29, 2015, 9 Pgs.
International Search Report and Written Opinion for International Application PCT/US2014/033510, report completed Jan. 8, 2015, 2014, Mailed Jan. 8, 2015, 11 Pgs.
International Search Report and Written Opinion for International Application PCT/US2014/056615, report completed Dec. 29, 2014, Mailed Dec. 30, 2014, 13 Pgs.
Kim et al., "Weldability of Cu54Zr22Ti18Ni6 bulk metallic glass by ultrasonic welding processing", Materials Letters, 2014, 130, pp. 160-163.
"Harmonic Drive Polymer GmbH", printed Feb. 20, 2014 from http://www.harmonicdrive.de/English/the-company/subsidiaries/harmonic-drive-polymer-gmbh.html, 1 pg.
"Introduction to Thermal Spray Processing", ASM International, Handbook of Thermal Spray Technology (#06994G), 2004, 12 pgs.
Abrosimova et al., "Crystalline layer on the surface of Zr-based bulk metallic glasses", Journal of Non-Crystalline solids, 2001, vol. 288, pp. 121-126.
An et al., "Synthesis of single-component metallic glasses by thermal spray of nanodroplets on amorphous substrates", Applied Physics Letters, 2012, vol. 100, pp. 041909-1-041909-4, Jan. 26, 2012.
Anstis et al., "A Critical Evaluation of Indentation Techniques for Measuring Fracture Toughness: I, Direct Crack Measurements", Journal of American Ceramic Society, Sep. 1981, vol. 64, No. 8, pp. 533-538.
Ashby et al., "Metallic glasses of structural materials", Scripta Materialia, 2006, vol. 54, pp. 321-326.
Bakkal, "Sliding tribological characteristics of Zr-based bulk metallic glass under lubricated conditions", Intermetallics, 2010, vol. 18, pp. 1251-1253.
Bardt et al., "Micromolding three-dimensional amorphous metal structures", J. Mater. Res, Feb. 2007, vol. 22, No. 2, pp. 339-343.
Basu et al., "Laser surface coating of Fe—Cr—Mo—Y—B—C bulk metallic glass composition on AISI 4140 steel", Surface & Coatings Technology, 2008, vol. 202, pp. 2623-2631.
Boopathy et al., "Near-threshold fatigue crack growth in bulk metallic glass composites", J. Mater. Res., vol. 24, No. 12, pp. 3611-3619.
Branagan et al., "Wear Resistant Amorphous and Nanocomposite Steel Coatings", Met. Mater. Trans. A, 2001, 32A; Idaho National Engineering and Environmental Laboratory, DOI 10.1007/s11661-001-0051-8, 15 pgs., Oct. 1, 2001.
Cadney et al., "Cold gas dynamic spraying as a method for freeforming and joining materials", Science Direct, Surface & Coatings Technology, 202, 2008, pp. 2801-2806, Oct. 17, 2007.
Calin et al., "Improved mechanical behavior of Cu—Ti-based bulk metallic glass by in situ formation of nanoscale precipitates", Scripta Materialia, 2003, vol. 48, pp. 653-658.
Chen et al., "Elastic Constants, Hardness and Their Implications to Flow Properties of Metallic Glasses", Journal of Non-crystalline Solids, 1975, vol. 18, pp. 157-171.
Chen et al., "Formation of Micro-Scale Precision Flexures Via Molding of Metallic Glass", Source and date unknown, 4 pgs.
Chen et al., "Influence of laser surface melting on glass formation and tribological behaviors of Zr55A110Ni5Cu30 alloy", J. Mater Res. Oct. 28, 2011, vol. 26, No. 20, pp. 2642-2652.
Cheng, "Characterization of mechanical properties of FeCrBSiMn-NbY metallic glass coatings", J Mater Sci., 2009, vol. 44, pp. 3356-3363, Apr. 16, 2009.
Choi et al., "Tribological behavior of the kinetic sprayed Ni59Ti16Zr20Si2Sn3", Journal of Alloys and Compounds, 2007, vol. 434-435, pp. 64-67.
Conner et al., "Shear band spacing under bending of Zr-based metallic glass plates", Acta Materialia, 2004, vol. 52, pp. 2429-2434.
Conner et al., "Shear bands and cracking of metallic glass plates in bending", Journal of Applied Physics, Jul. 15, 2003, vol. 94, No. 2, pp. 904-911.
Dai et al., "A new centimeter-diameter Cu-based bulk metallic glass", Scripta Materialia, 2006, vol. 54, pp. 1403-1408.
Davis, "Hardness/Strength Ratio of Metallic Glasses", Scripta Metallurgica, 1975, vol. 9, pp. 431-436.
De Beer et al., "Surface Folds Make Tears and Chips", Physics, 2012, vol. 100, 3 pgs.
Dislich et al., "Amorphous and Crystalline Dip Coatings Obtained from Organometallic Solutions: Procedures, Chemical Processes and Products", Metallurgical and Protective Coatings, 1981, vol. 77, pp. 129-139.
Duan et al., "Lightweight Ti-based bulk metallic glasses excluding late transition metals", Scripta Materialia, 2008, vol. 58, pp. 465-468.
Duan et al., "Tribological properties of Zr41.25Ti13.75Ni10Cu12.5Be22.5 bulk metallic glasses under different conditions", Journal of Alloys and Compounds, 2012, 528. pp. 74-78.
Fleury et al., "Tribological properties of bulk metallic glasses", Materials Science and Engineering, 2004, vol. A375-377, pp. 276-279.
Fornell et al., "Enhanced mechanical properties and in vitro corrosion behavior of amorphous and devitrified T140Zr10Cu38Pd12 metallic glass", Journal of the Mechanical Behavior of Biomedical Materials, 2011, vol. 4, pp. 1709-1717.
Ganesan et al. "Bonding behavior studies of cold sprayed copper coating on the PVC polymer substrate", Surface & Coatings Technology, 2012, vol. 207, pp. 262-269.
Garrett et al., "Effect of microalloying on the toughness of metallic glasses", Applied Physics Letter, 2012, vol. 101, 241913-1-241913-3.
Gleason Corporation, "Gear Product News", Introducing genesis, The Next Generation in Gear Technology, Apr. 2006, 52 pgs.
Gloriant, "Microhardness and abrasive wear resistance of metallic glasses and nanostructured composite materials", Journal of Non-Crystalline Solids, 2003, vol. 316, pp. 96-103.
Greer, "Partially or fully devitrified alloys for mechanical properties", Materials and Science and Engineering, 2001, vol. A304, pp. 68-72.
Greer et al., "Wear resistance of amorphous alloys and related materials", International Materials Reviews, 200, vol. 47, No. 2, pp. 87-112.
Hale, "Principles and Techniques for Designing Precision Machines", Ph.D. Thesis, Feb. 1999, 493 pgs.
Harmonic Drive AG, website, printed from http://harmoncdrive.aero/?idcat=471, Feb. 20, 2014, 2 pgs.
Haruyama et al., "Volume and enthalpy relaxation in Zr55Cu30Ni5Al10 bulk metallic glass", Acta Materialia, 2010, vol. 59, pp. 1829-1836.
Hejwowski et al., "A comparative study of electrochemical properties of metallic glasses and weld overlay coatings", Vacuum 88 (2013) 118-123, Feb. 20, 2012.

(56) References Cited

OTHER PUBLICATIONS

Hofmann, "Bulk Metallic Glasses and Their Composites: A Brief History of Diverging Fields", Journal of Materials, 2013, vol. 2013, 7 pgs.
Hofmann, "Shape Memory Bulk Metallic Glass Composites", Science, Sep. 10, 2010, vol. 329, pp. 1294-1295.
Hofmann et al., "Designing metallic glass matrix composites with high toughness and tensile ductility", Nature Letters, Feb. 28, 2008, vol. 451, pp. 1085-1090.
Hofmann et al., "Semi-solid Induction Forging of Metallic Glass Matrix Composites", JOM, Dec. 2009, vol. 61, No. 12, pp. 11-17, plus cover.
Hong et al., "Dry sliding tribological behavior of Zr-based bulk metallic glass", Trans. Nonferrous Met. Soc. China, 2012, vol. 22, pp. 585-589.
Hong et al., "Microstructural characteristics of high-velocity oxygen-fuel (HVOF) sprayed nickel-based alloy coating", Journal of Alloys and Compounds 581 (2013) pp. 398-403, Jul. 26, 2013.
Huang et al., "Fretting wear behavior of bulk amorphous steel", Intermetallics, 2011, vol. 19, pp. 1385-1389.
Inoue et al., "Cobalt-based bulk glassy alloy with ultrahigh strength and soft magnetic properties", Nature Materials, Oct. 2003, vol. 2, pp. 661-663.
Inoue et al., "Preparation of 16 mm diameter Rod of Amorphous Zr65A17.5Ni10Cu17.5 Alloy", Material Transactions, JIM, 1993, vol. 34, No. 12, pp. 1234-1237.
Ishida et al., "Wear resistivity of super-precision microgear made of Ni-based metallic glass", Materials Science and Engineering, 2007, vol. A449-451, pp. 149-154.
Jiang et al, "Progress in low density bulk metallic glasses and their composites", pp. 1-56.
Jiang et al., "Tribological Studies of a Zr-Based Glass-Forming Alloy with Different States", Advanced Engineering Materials, 2009, vol. 1, No. 11, pp. 925-931.
Kahraman et al., "A Feasibility Study on Development of Dust Abrasion Resistant Gear Concepts for Lunar Vehicle Gearboxes", NASA Grant NNX07AN42G Final Report, Mar. 11, 2009, 77 pgs.
Kim, "Amorphous phase formation of Zr-based alloy coating by HVOF spraying process", Journal of Materials Science 36 (2001) pp. 49-54.
Kim et al. "Enhancement of metallic glass properties of Cu-based BMG coating by shroud plasma spraying", Science Direct, Surface & Coatings Technology 205 (2011) pp. 3020-3026.
Kim et al. "Oxidation and crystallization mechanisms in plasma-sprayed Cu-based bulk metallic glass coatings", Acta Materialia. 2010, vol. 58, pp. 952-962.
International Preliminary Report on Patentability for International Application No. PCT/US2014/056615, Report Issued Mar. 22, 2016, Mailed Mar. 31, 2016, 11 Pgs.
"Corrosion of Titanium and Titanium Alloys", Total Materia, http://www.totalmateria.com/Article24.htm, Published Sep. 2001, Accessed Feb. 16, 2016.
Inoue, A. et al., "Recent development and application products of bulk glassy alloys", Acta Materialia, vol. 59, Issue 6, Jan. 20, 2011, 2243-2267.
Nishiyama, N. et al., "Recent progress of bulk metallic glasses for strain-sensing devices", Materials Science and Engineering: A, vols. 449-451, Mar. 25, 2007, 79-83.
Hu et al., "Crystallization Kinetics of the Cu47.5Zr74.5A15 Bulk Metallic Glass under Continuous and Iso-thermal heating", App. Mech. and Materials, vols. 99-100, Sep. 8, 2011, p. 1052-1058.
Jiang et al., "Low-Density High-Strength Bulk Metallic Glasses and Their Composites: A Review", Advanced Engineering Materials, DOI: 10.1002/adem.201400252, Nov. 19, 2014, pp. 1-20.
Song et al., "Strategy for pinpointing the formation of B2 CuZr in metastable CuZr-based shape memory alloys", Acta Materialia 59, Aug. 6, 2011, 6620-6630.
Wu et al., "Formation of Cu—Zr—Al bulk metallic glass composites with improved tensile properties", Acta Materialia 59, Feb. 19, 2011, pp. 2928-2936.
International Preliminary Report on Patentability for International Application PCT/US2014/033510, Report issued Oct. 12, 2016, Mailed Oct. 20, 2016, 9 pgs.
"Gear", Dictionary.com. Accessed Aug. 30, 2016.
"Group 4 element", VVikipedia. https://en.wikipedia.org/wiki/Group_4_element. Published Jun. 11, 2010. Accessed Aug. 24, 2016.
Nishiyama et al., "Development and applications of late transition metal bulk metallic glasses", Bulk Metallic Glasses. pp. 1-25. 2008.
Zhang et al., "Developments and applications of bulk metallic glasses", Rev. Adv. Mater. Sci. 18 (2008) 1-9.

* cited by examiner

SYSTEMS AND METHODS FOR IMPLEMENTING BULK METALLIC GLASS-BASED MACROSCALE COMPLIANT MECHANISMS

CROSS-REFERENCE TO RELATED APPLICATIONS

The current application claims priority to U.S. Provisional Application No. 61/672,656, filed Jul. 17, 2012, the disclosure of which is incorporated herein by reference.

STATEMENT OF FEDERAL FUNDING

The invention described herein was made in the performance of work under a NASA contract, and is subject to the provisions of Public Law 96-517 (35 U.S.C. 202) in which the Contractor has elected to retain title.

FIELD OF THE INVENTION

The present invention generally relates to bulk metallic glass-based macroscale compliant mechanisms.

BACKGROUND

Generally speaking, 'mechanisms' are mechanical devices that transfer or transform motion, force, or energy. For example, a reciprocating engine (e.g. in an automobile where the linear motion of a piston is converted to the rotational motion of a wheel) is a mechanism that converts linear motion into rotational motion. 'Compliant mechanisms' can be understood to be those mechanisms that achieve the transfer or transformation of motion, force, or energy via the elastic bending of their flexible members.

A relatively new class of materials that may be considered for the fabrication of compliant mechanisms are metallic glasses, also known as amorphous alloys. Metallic glasses are characterized by their disordered atomic-scale structure in spite of their metallic constituent elements—i.e. whereas conventional metallic materials typically possess a highly ordered atomic structure, metallic glass materials are characterized by their disordered atomic structure. Notably, metallic glasses typically possess a number of useful material properties that can allow them to be implemented as highly effective engineering materials. For example, metallic glasses are generally much harder than conventional metals, and are generally tougher than ceramic materials. They are also relatively corrosion resistant, and, unlike conventional glass, they can have good electrical conductivity. Importantly, the manufacture of metallic glass materials lends itself to relatively easy processing. In particular, the manufacture of a metallic glass can be compatible with an injection molding process.

Nonetheless, the manufacture of metallic glasses presents challenges that limit their viability as engineering materials. In particular, metallic glasses are typically formed by raising a metallic alloy above its melting temperature, and rapidly cooling the melt to solidify it in a way such that its crystallization is avoided, thereby forming the metallic glass. The first metallic glasses required extraordinary cooling rates, e.g. on the order of $10^6$ K/s, and were thereby limited in the thickness with which they could be formed. Indeed, because of this limitation in thickness, metallic glasses were initially limited to applications that involved coatings. Since then, however, particular alloy compositions that are more resistant to crystallization have been developed, which can thereby form metallic glasses at much lower cooling rates, and can therefore be made to be much thicker (e.g. greater than 1 mm). These thicker metallic glasses are known as 'bulk metallic glasses' ("BMGs").

In addition to the development of BMGs, 'bulk metallic glass matrix composites' (BMGMCs) have also been developed. BMGMCs are characterized in that they possess the amorphous structure of BMGs, but they also include crystalline phases of material within the matrix of amorphous structure. For example, the crystalline phases can exist in the form of dendrites. The crystalline phases can allow the material to have enhanced ductility, compared to where the material is entirely constituted of the amorphous structure.

Although metallic glasses and their composites can now be formed in dimensions that can allow them to be more useful, the current state of the art has yet to understand the properties of BMG-based materials (throughout the application, the term 'BMG-based materials' is meant to be inclusive of BMGs and BMGMCs, except where otherwise noted) to an extent where they can be used in the design, fabrication, and implementation of superior 'macroscale' compliant mechanisms, e.g. those where the operative/strained member has a thickness greater than 0.5 mm. Accordingly, there exists a need to have a fuller understanding of the material properties of BMG-based materials such that superior BMG-based macroscale compliant mechanisms can be efficiently designed, fabricated, and implemented.

SUMMARY OF THE INVENTION

Systems and methods in accordance with embodiments of the invention implement bulk metallic glass-based macroscale compliant mechanisms. In one embodiment, a bulk metallic glass-based macroscale compliant mechanism includes: a flexible member that is strained during the normal operation of the compliant mechanism; where the flexible member has a thickness of 0.5 mm; where the flexible member comprises a bulk metallic glass-based material; and where the bulk metallic glass-based material can survive a fatigue test that includes 1000 cycles under a bending loading mode at an applied stress to ultimate strength ratio of 0.25.

In another embodiment, the bulk metallic glass-based material is a bulk metallic glass matrix composite.

In yet another embodiment, the volume fraction of crystals within the bulk metallic glass matrix composite is between approximately 20% and 80%.

In still another embodiment, the bulk metallic glass-based material has a yield strain greater than approximately 1.5%.

In still yet another embodiment, the bulk metallic glass-based material has a strength to stiffness ratio greater than approximately 2.

In a further embodiment, the bulk metallic glass-based material is one of: Composite DV1; Composite DH3, Composite LM2, Composite DH1, Composite DH1A, and Composite DH1 B.

In a yet further embodiment, the bulk metallic glass-based macroscale compliant mechanism is a TiZrBeXY alloy, wherein X is an additive that enhances glass forming ability and Y is an additive that enhances toughness.

In a still further embodiment, the bulk metallic glass-based material includes: Ti in an amount between approximately 10 and 60 atomic %; Zr in an amount between approximately 18 and 60 atomic %; and Be in an amount between approximately 7 and 30 atomic %.

In a still yet further embodiment, X is one of Fe, Cr, Co, Ni, Cu, Al, B, C, Al, Ag, Si, and mixtures thereof.

In another embodiment, X is one of C, Si, and B; and X is present in an amount less than approximately 2 atomic %.

In yet another embodiment, X is one of Cr, Co, and Fe; and X is present in an amount less than approximately 7 atomic %.

In still another embodiment, X is Al and is present in an amount less than approximately 7 atomic %.

In still yet another embodiment, X is a combination of Cu and Ni, and is present in an amount less than approximately 20 atomic %.

In a further embodiment, the combination of X and Be is present in an amount less than approximately 30 atomic %.

In a yet further embodiment, Y is one of V, Nb, Ta, Mo, Sn, W, and mixtures thereof.

In a still further embodiment, Y is V and is present in amount less than approximately 15 atomic %.

In a still yet further embodiment, Y is Nb and is present in an amount between approximately 5 and 15 atomic %.

In another embodiment, Y is Ta and is present in an amount less than approximately 10 atomic %.

In still another embodiment, Y is Mo and is present in an amount less than approximately 5 atomic %.

In yet another embodiment, Y is Sn and is present in an amount less than approximately 2 atomic %.

In still yet another embodiment, the bulk metallic glass-based material can survive a fatigue test that includes 1000 cycles under a bending loading mode at an applied stress to ultimate strength ratio of 0.4.

In a further embodiment, the compliant mechanism is a cutting device that includes: a bladed section with a first and second blade; and a handled section with a first and second handle; where the cutting device is configured such that the rotation of the handles towards one another causes the rotation of the blades towards one another.

In a still further embodiment, the compliant mechanism is a grasping device that includes: a grasping section with a first and second grasping element; and a handled section with a first and second handle; where the grasping device is configured such that the rotation of the handles towards one another causes the rotation of the grasping elements towards one another.

In a still yet further embodiment, the compliant mechanism is a bistable mechanism that is configured to be stable in two configurations.

In another embodiment, the compliant mechanism is a rotational hexfoil flexure that includes: a base cylindrical portion; an overlaid cylindrical portion; and three beams; where one end of each beam is adjoined to the base cylindrical portion, and the opposite end of each beam is adjoined to the overlaid cylindrical portion; where the rotational hexfoil flexure is configured such that the base cylindrical portion and the overlaid cylindrical portion can be rotated relative to one another.

In a further embodiment, a method of manufacturing a bulk metallic glass matrix composite-based macroscale compliant mechanism includes: forging a bulk metallic glass matrix composite material into a mold; removing the bulk metallic glass matrix composite material from the mold; and excising any remnant excess material.

In a still further embodiment, the bulk metallic glass matrix composite material is removed from the mold using a steel, through-the thickness, punching tool.

DETAILED DESCRIPTION

Turning now to the drawings, systems and methods for implementing bulk metallic glass-based macroscale compliant mechanisms are illustrated. Compliant mechanisms can be understood to be mechanisms that transfer or transform motion, force, or energy via the elastic bending of their flexible members. They can be contrasted with mechanisms that achieve the transfer or transformation of motion, force, or energy via rigid body kinematics. In other words, whereas conventional mechanisms may rely on rigid body kinematics to achieve their operation, compliant mechanisms generally rely on strain energy to do so. Indeed, in many cases, compliant mechanisms are designed to replace multi-part elements such as rigid body pin joints.

Note that the term 'compliant mechanism' often refers to mechanisms that are more intricate than simple torsional or linear springs, although compliant mechanisms can include simple torsional or linear springs. In many cases, compliant mechanisms redirect a motion, force, or energy, in a direction other than that which directly opposes the direction under which the initial actuating motion, force, or energy was input. Additionally, compliant mechanisms are often designed to survive many cycles of operation. For example, they may be designed to survive a thousand cycles of operation.

Compliant mechanisms generally utilize materials that can be characterized by an elastic region for which an experienced stress (e.g. tension or compression) is linearly correlated with the applied strain. In other words, many materials have an elastic region, for which:

$$\sigma = E\epsilon$$

where:

$\sigma$ is the stress experienced by the materials

E is the Young's Modulus of the material, or its 'stiffness'; and $\epsilon$ is the extent to which the material is strained.

Figure 1:
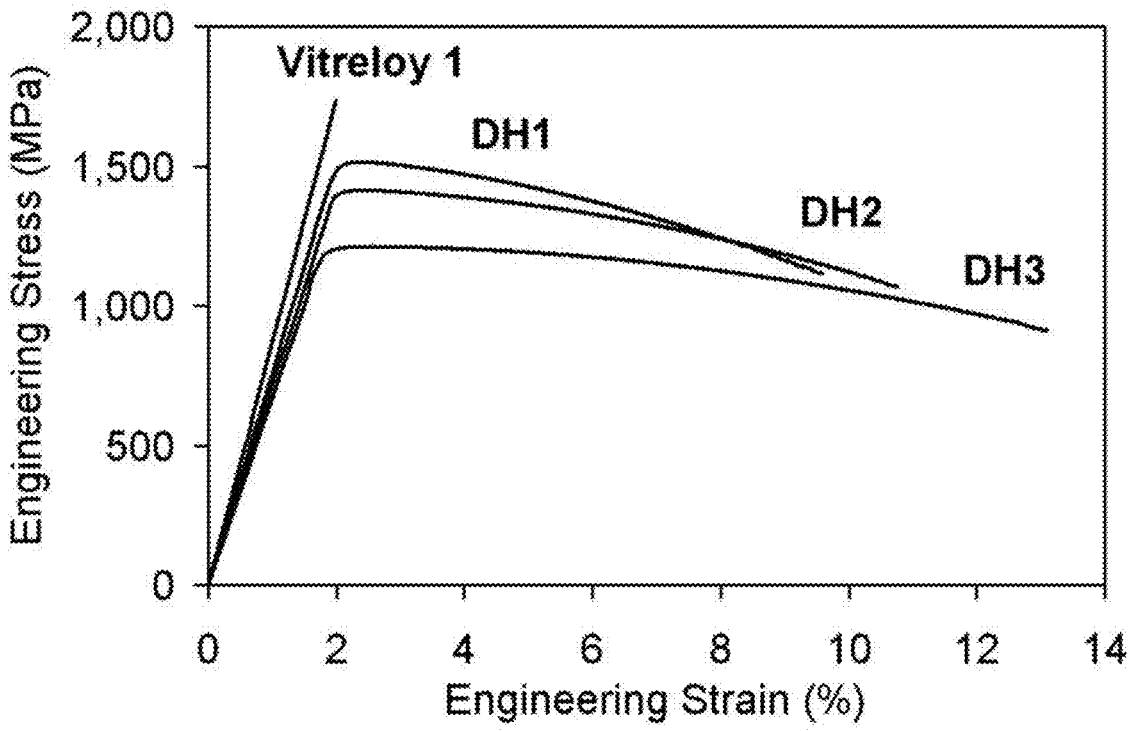
FIG. 1 illustrates a stress-strain plot of several common BMG-based materials.

As an example, FIG. 1 illustrates typical stress-strain curves for several bulk metallic glasses. Note that stress and strain are linearly correlated up until approximately 2%.

Generally, when these materials are strained (to an extent not exceeding their respective elastic limits), energy is stored within them ('strain energy'). The energy per unit volume generally correlates with the area under the material's stress-strain curve through the point at which the material is strained, and it is this energy that may be available for work. Generally, compliant mechanisms utilize these principles to achieve their functionality. More specifically, compliant mechanisms typically include at least one flexible member which is relied upon during the normal operation of the compliant mechanism for its ability to strain and utilize strain energy.

Figure 2A:
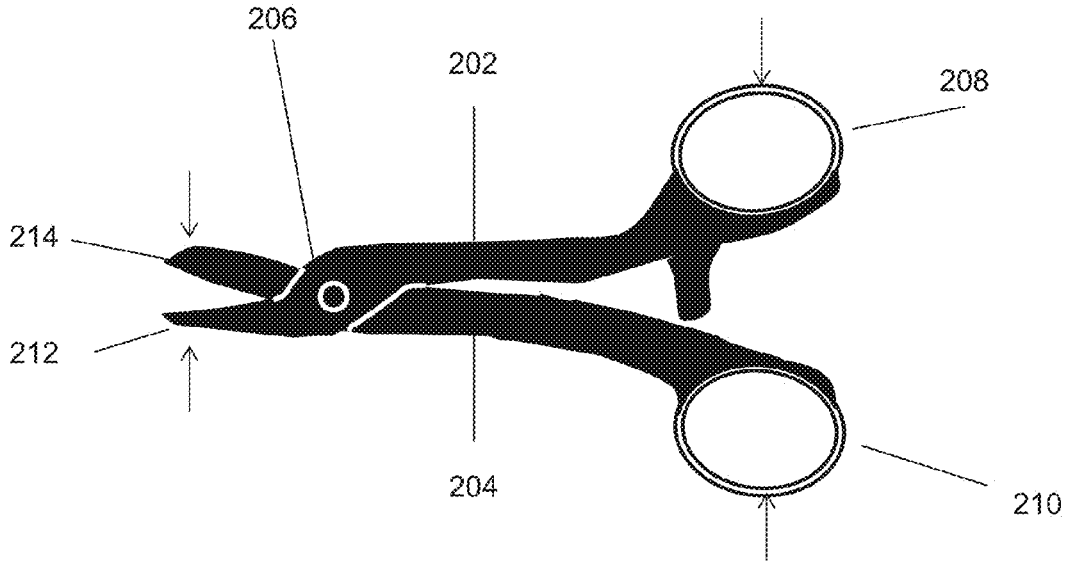
FIGS. 2A-2B illustrate a rigid body cutting device and an equivalent compliant mechanism cutting device.
Figure 2B:
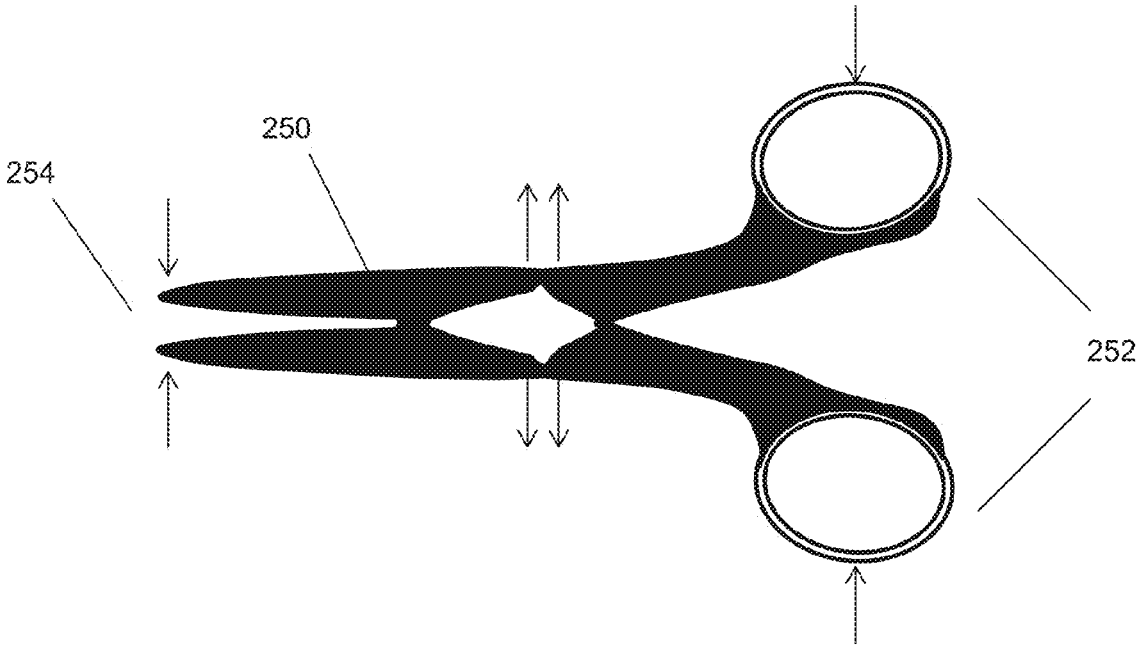

For example, FIGS. 2A and 2B illustrate a cutting device in a rigid body form and an equivalent compliant mechanism form. In particular, the rigid body cutting device depicted in FIG. 2A is composed of a first cutting member 202, a second cutting member 204, and a hinge 206, about which the first cutting member 202 and the second cutting member 204, are hingedly coupled. The first cutting member 202, and second cutting member 204, each have a handle section, 208 and 210 respectively, as well as a blade section, 212 and 214 respectively. The rotation of the handle sections, 208 and 210, towards each other causes the blade sections, 212 and 214, to also rotate towards each other.

By contrast, the equivalent compliant mechanism depicted in FIG. 2B is composed of a single monolithic piece, 250, that can achieve a similar function with the same actuation. In particular, the monolithic piece, 250, includes a handled section 252 with handles, and a bladed section 254 with blades. The monolithic piece is designed such that when the handles of the handled section 252 are rotated towards one another the blades of the bladed section 254 are also rotated towards one another, and can thereby achieve a cutting function. As can be inferred from the illustration and this discussion, the cutting device utilizes the flexibility of its constituent members to strain and utilizes this strain energy.

Similarly, grasping compliant mechanisms can also be constructed using a similar design, e.g. replacing the bladed section with a grasping section that includes a first grasping element and a second grasping element.

Compliant mechanisms can be advantageous in a number of respects. For example, as can be inferred from above, mechanisms that rely on rigid body kinematics often employ multiple discrete elements, including pins, bearings, screws, and other such linking components. These multiple components usually have to be distinctly manufactured and then assembled. Thus, the manufacture of such mechanisms can be considered to be inefficient in these respects. Moreover, during their operation, such mechanisms often rely on component-to-component interaction—which can result in friction that can impede the performance of the mechanism and/or result in wear. Any resulting such friction can require that the mechanism be sufficiently lubricated, which increases the sophistication of the system; and of course, any wear can compromise the lifespan of the mechanism. Compliant mechanisms can mitigate these deficiencies. For example, the operative/stressed portions of compliant mechanisms can be made to be monolithic, and thus the manufacturing complexities can be reduced, i.e. whereas mechanisms that rely on rigid body kinematics typically require the manufacture and subsequent assembly of multiple discrete elements, compliant mechanisms do not have to be as intricate. Similarly, because of the reduction of components, compliant mechanisms may also be produced more economically. Moreover, as compliant mechanisms primarily do not rely on rigid body kinematics, any deficiencies that arise from part to part interaction (e.g. friction and wear) can be eliminated.

Although compliant mechanisms can provide numerous benefits, their design and manufacture can be challenging. In particular, it has traditionally been challenging to model the input and transfer of forces, motion, and energy through a compliant mechanism; in many instances, this modeling directly informs the design of the compliant mechanism. Additionally, as they are usually intricate and monolithic, compliant mechanisms are typically not fabricated from metallic materials. For example, the fabrication of a compliant mechanism from robust metallic materials entails either: EDM or computer controlled machining, which can be overly costly; casting, which is typically limited to low melting temperature metals; or additive manufacturing, which can be time consuming. Thus, compliant mechanisms are typically fabricated from polymers, which can be easily cast into the intricate shapes (as alluded to above, many compliant mechanism designs call for intricate structures). Unfortunately, these polymers usually do not possess desirable mechanical properties.

Bulk metallic glasses (BMGs) and bulk metallic glass composites (BMGMCs) have a number of useful properties that would suggest that they would be well-suited for the fabrication of compliant mechanisms. Note that throughout this application, the term 'BMG-based material', along with any equivalent term, is meant to reference both BMGs and BMGMCs. For example, BMG-based materials can be easily cast like polymers, but at the same time can be developed to possess desirable mechanical properties. For instance, in many cases, it is desirable for compliant mechanisms to be fabricated from materials that have relatively high elastic strain limits, and it may also be desirable for compliant mechanisms to be constituted from materials that have relatively high strength to stiffness ratios. Table 1 below illustrates the material properties of some typical BMG-based materials relative to other typical engineering materials, and conveys their superior yield strains and strength to stiffness ratios.

TABLE 1

Mechanical Properties of Typical BMGs vs. Traditional Engineering Materials

| Material | Density (g/cc) | Stiffness (GPa) | Yield Strength (MPa) | Yield Strain (%) | Processing T (° C.) | Strength/ Stiffness |
|---|---|---|---|---|---|---|
| Stainless Steel 304 | 8.0 | 193-200 | 215 | 0.1 | 1400 | 0.1 |
| Invar 36 | 8.1 | 141 | 276 | 0.3 | 1427 | 0.2 |
| Ti-6Al-4V | 4.4 | 114 | 965 | 1.0 | 1604 | 0.8 |
| Pure Titanium | 4.5 | 116 | 140 | 0.1 | 1650 | 0.1 |
| Al-6061 | 2.7 | 69 | 276 | 0.4 | 582 | 0.4 |
| Al-7075 | 2.8 | 72 | 462 | 0.6 | 477 | 0.6 |
| Zr & Ti BMGs | 4.4-6.0 | 70-115 | 1500-2500 | 2.0 | 350-600 | 2.7 |
| Ti-BMG Composites | 4.9-6.4 | 70-115 | 1000-1500 | 1.5-2.0 | 350-682 | 2 |

Note also that the stiffness of the BMG-based materials is relatively low compared to the other listed engineering materials. In many instances, it is desirable to fabricate compliant mechanisms from materials that have a relatively low stiffness. This can allow a flexible member of a compliant mechanism to deflect more easily. For example, the deflection of a beam can be determined using the relationship:

$$\delta=(FL^3)/(3EI)$$

where

F is the force applied to the end of the beam;

L is the length of the beam;

E is the stiffness; and

I is the moment of inertia, which in the case of a rectangular beam is ($bh^3/12$).

Accordingly, with a lower stiffness, greater deflection can be achieved with less force.

Moreover, in addition to these advantageous mechanical properties, BMG-based materials can also have additional characteristics that can further boost their utility, e.g. biocompatibility, corrosion resistance, and density.

Nonetheless, in spite of their vast potential as engineering materials, the practical implementation of BMG-based materials has been largely limited to microscale structures. Specifically, various publications have concluded, and it is largely established, that the viability of BMG-based materials is limited to microscale structures. (See e.g., G. Kumar et al., Adv. Mater. 2011, 23, 461-476, and M. Ashby et al., Scripta Materialia 54 (2006) 321-326, the disclosures of which are hereby incorporated by reference.) For example, others have fabricated geometries that are akin to compliant mechanisms on the microscale—selected illustrations of produced structures are reproduced in FIGS. 3A-3D. (See G. Kumar et al., Adv. Mater. 2011, 23, 461-476.)

Figure 3A:
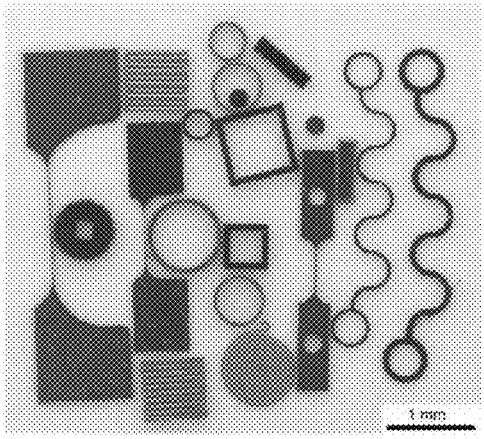
FIGS. 3A-3D illustrate compliant mechanisms that have been formed from BMGs on a microscale.
Figure 3B:
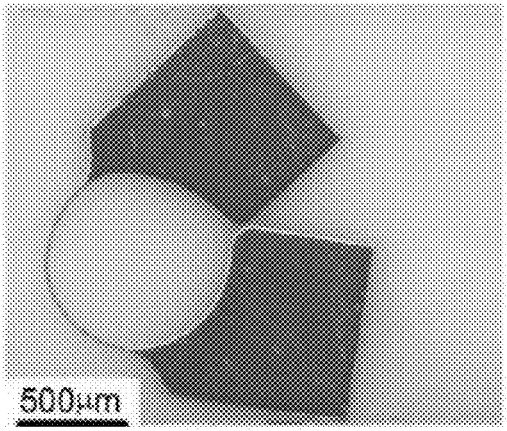
Figure 3C:
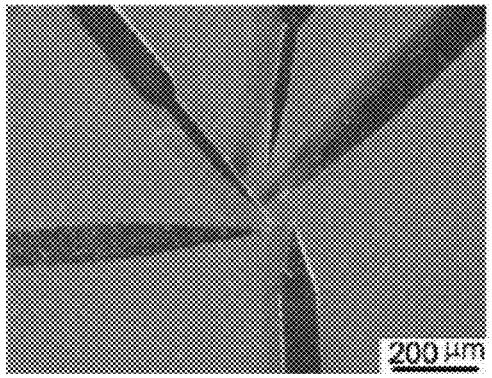
Figure 3D:
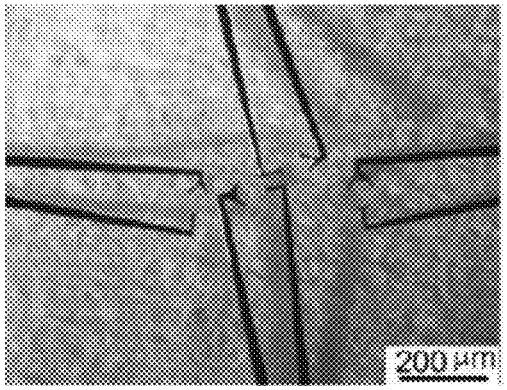

In particular FIG. 3A depicts an assortment of structures including beams, pillars, pipes, square donuts, wavy structures, gears, mechanical testing specimens, springs, and flexible living hinges. FIG. 3B depicts complete bending without plastic deformation. FIG. 3C depicts micro tweezers. And FIG. 3D depicts microscalpels. Note that the thickness of the strained members were fabricated on a miniscule scale, for example much less than 0.5 mm. This is in part because the material properties, including the fracture mechanics, of BMG-based materials are correlated with the specimen size. For example, it has been observed that the ductility of a BMG material is inversely correlated with its thickness. (See e.g., Conner, Journal of Applied Physics, Volume 94, Number 2, Jul. 15, 2003, pgs. 904-911, the disclosure of which is hereby incorporated by reference.) Essentially, as component dimensions become greater, they become more and more prone to brittle failure. Thus, for these reasons and others, those skilled in the art have generally counseled that although BMG-based materials may make for excellent materials for microscale structures, e.g. MEMS devices, they generally should not be used for macroscale components. (See e.g., G. Kumar et al., Adv. Mater. 2011, 23, 461-476.) Indeed, G. Kumar et al. have related brittle failure to the plastic zone size, and have generalized that a specimen thickness of approximately 10 times the plastic zone radius can exhibit 5% bending plasticity. (Id.) Thus, G. Kumar et al. conclude that a 1 mm thick specimen of Vitreloy can exhibit 5% bend plasticity. (Id.)

Figure 4:
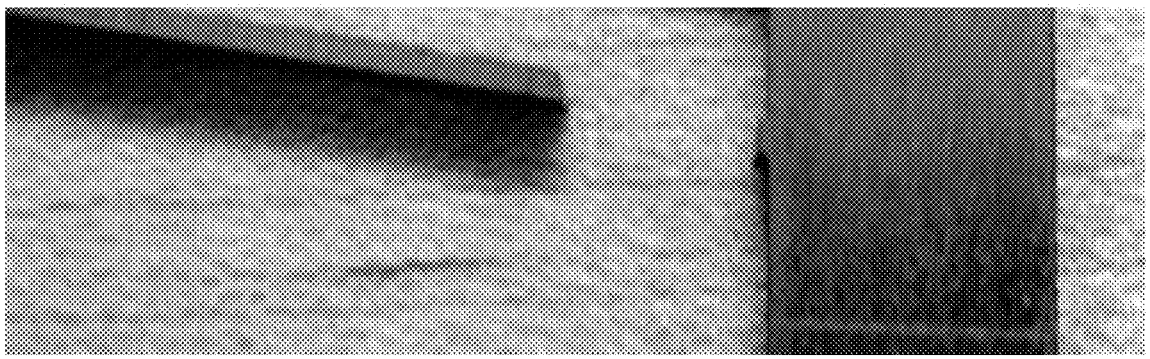
FIG. 4 illustrates how when a macroscale compliant flexure was formed from a Vitreloy (a common BMG) on a macroscale, the mechanism failed in less than 10 cycles.

The Inventors of the instant application fabricated a compliant flexure that included 1 mm struts out of Vitreloy. Although the compliant mechanism was successfully fabricated, the inventors observed that the compliant mechanism failed via fatigue failure after merely 10 cycles. The failed strut is illustrated in FIG. 4.

The inventors thereby observed that, contrary to the suggestions of the scientific literature, BMG-based materials may be successfully employed within macroscale compliant mechanisms if they can be developed to withstand fatigue failure. In other words, the presumed lack of plasticity of BMG-based materials on a macroscale is not the only consideration when attempting to form a compliant mechanism from a BMG-based material. Indeed, as will be discussed further below, the inventors have developed BMG-based materials that possess requisite mechanical properties including a requisite resistance to fatigue failure, and are thereby suitable for the fabrication of compliant mechanisms. Thus, in many embodiments of the invention, a BMG-based macroscale compliant mechanism includes: a flexible member that is strained during the normal operation of the compliant mechanism; where the flexible member has a thickness of 0.5 mm; where the flexible member comprises a BMG-based material; and where the BMG-based material can survive a fatigue test that includes 1000 cycles under a bending loading mode at an applied stress to ultimate strength ratio of 0.25.

Additionally, advantageous manufacturing methods for fabricating compliant mechanisms from BMGMCs are discussed. In particular, as BMGMCs may exhibit high viscosity, they may be advantageously manipulated using squeeze-casting techniques.

The BMG-based material selection and design methodology for macroscale compliant mechanisms is now discussed below.

BMG-Based Material Selection and Design Methodology for Compliant Mechanisms

Figure 5:
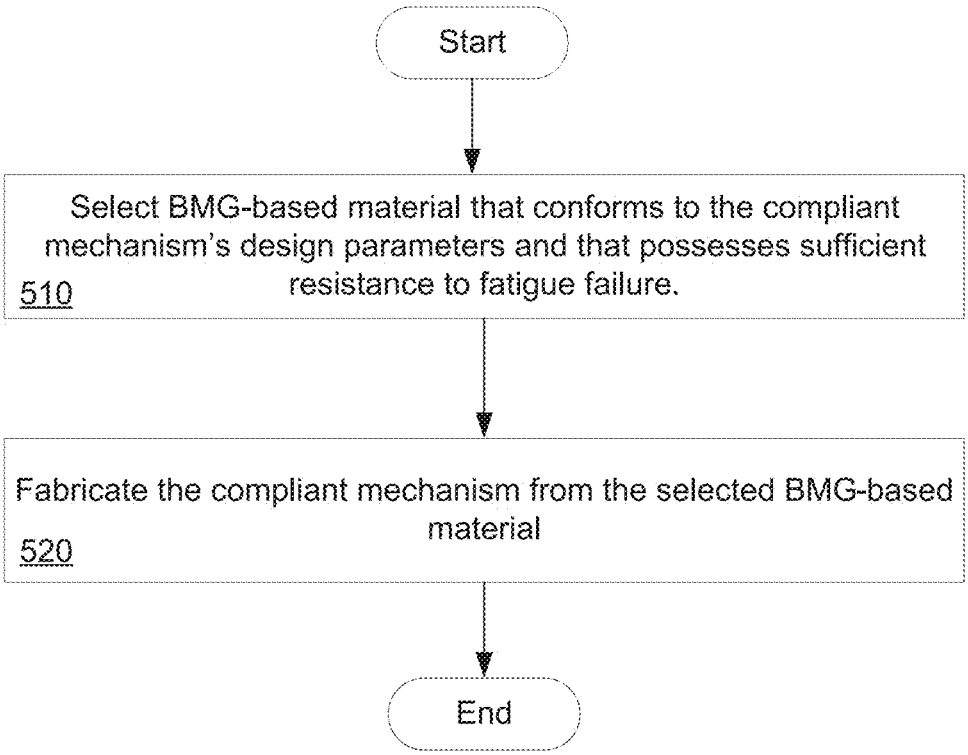
FIG. 5 illustrates a method for fabricating superior BMG-based compliant mechanisms.

Whereas, existing scientific literature has generally counseled against employing BMG-based materials in macroscale structures that may experience strain for reasons including BMG-based materials' tendencies to fail under brittle modes on a macroscale, the inventors of the instant application have determined that BMG-based materials can indeed be implemented in structures that are strained—they can in fact be implemented in macroscale structures that rely on a material's ability to store and utilize strain energy. However, the inventors have observed that in selecting/developing a BMG-based material to be implemented in a BMG-based material, the fatigue characteristics of the material must be considered. Thus, in many embodiments of the invention, a method of fabricating a BMG-based macroscale compliant mechanism includes accounting for the fatigue characteristics of the BMG-based material. A method of fabricating a BMG-based macroscale compliant mechanism that includes selecting a BMG-based material that conforms to the compliant mechanism's design parameters and that also has a sufficient resistance to fatigue failure, and fabricating the compliant mechanism from the selected BMG-based material, is illustrated in FIG. 5. Of course, the requisite design parameters can be obtained in any way, and can include any number of considerations. For example, in some embodiments the flexible member of the compliant mechanism that will be elastically deforming and relied upon during normal operation of the compliant mechanism is identified, and the desired stiffness can be obtained based on the desired operation of the compliant mechanism. For instance, if a larger actuation force is desired, a stiffer material may be selected. Similarly, based on the anticipated operation, the minimum desired number of cycles to failure under normal operation can also be used as a design parameter. For example, if many loading cycles are anticipated, then a material with a relatively high resistance to fatigue failure may be selected.

Accordingly, a BMG-based material is selected (510) that conforms to the design parameters and that possesses a sufficient resistance to fatigue failure. Of course, any manner of assessing whether a BMG-based material has a sufficient resistance to fatigue failure can be employed. For example, in many instances, the selected BMG-based material must be able to withstand a fatigue test of 1000 cycles, where the loading mode is in bending, at an applied stress to ultimate tensile strength ratio of 0.25. In a number of embodiments, a material that can withstand 1000 cycles of an applied stress to ultimate tensile strength of 0.4 is selected. In many embodiments, a material that can withstand 100 cycles of an applied stress to ultimate tensile strength of 0.5 is selected. Of course, any number of cycles to failure can be required at any applied stress in accordance with embodiments of the invention. Generally, as compliant mechanisms are typically strained in tension, in rotation, or in bending, it is preferred that where fatigue testing is used to gauge the resistance to fatigue failure of the BMG, the fatigue test employ tension loading, bending loading, or rotational loading. Of course, any loading mode can be employed in assessing the resistance to fatigue of a candidate BMG-based material.

The compliant mechanism can then be fabricated (520) from the selected material. The compliant mechanism can be fabricated in any suitable way in accordance with embodiments of the invention. Moreover, the type of material selected can inform the specific fabrication methodology. For example, where a BMG is selected, the fabrication technique can be one of: die casting, thermoplastic forming, capacitive discharge, powder metallurgy, injection casting, sheet forming, wire EDM from larger parts, machining, suction casting, spray coating, and investment casting. Where a BMGMC is selected, the fabrication technique can be selected from one of: die casting, injection casting, semisolid processing, squeeze casting, and from sheet forming.

Moreover, in many embodiments, the design of the compliant mechanism may be tweaked to accommodate the fabrication method. For example, where standard die casting or injection molding is employed, blind features may be removed, or the thickness of the structural members may be increased.

The above-described method of fabrication informs how to select a BMG-based material for the fabrication of a compliant mechanism. Below, it is discussed how to develop a BMG-based material so that it possesses the requisite materials properties for implementation within a compliant mechanism.

Developing a BMG-Based Material for Use in a Compliant Mechanism

In many embodiments, a BMG-based material is particularly developed so that it is well suited for implementation within a compliant mechanism. Generally, the development of BMG-based materials so that they possess desired mechanical properties involves alloying. For example, in many instances it is desirable to implement a stiffer BMG material. Accordingly, in many embodiments, the stiffness of a BMG is increased by alloying the BMG material with B, Si, Al, Cr, Co, and/or Fe. These alloying elements are usually added in concentrations of less than 5%. Of course, any alloying elements can be implemented that enhance the stiffness of a BMG material.

The mechanical properties of BMGMC materials can also be developed via alloying. For example, in many embodiments, the stiffness of a BMGMC is decreased by increasing the volume fraction of soft, ductile dendrites or increasing the amount of beta stabilizing elements, e.g. V, Nb, Ta, Mo, Sn. Similarly, in a number of embodiments, the stiffness of a BMGMC is increased by decreasing the volume fraction of soft, ductile inclusions, increasing the hardness of the inclusions by either removing beta stabilizing elements, or adding elements that harden them, e.g. Al, W, Cr, Co, Mo, Si, B, etc. Generally, in BMGMCs, the stiffness of the material changes in accordance with the rule of mixtures, e.g., where there are relatively more dendrites, the stiffness decreases, and where there are relatively less dendrites, the stiffness increases.

Note that, generally, when modifying the stiffness of BMG-based materials, the stiffness is modified largely without overly influencing other properties, such as elastic strain limit or processability. This ability to tune the stiffness independent of the other material properties or influencing processability is greatly advantageous in designing compliant mechanisms, as it greatly facilitates the material development process.

Tables 2, 3, and 4 depict how the stiffness of a BMG-based material can vary based on composition, and how the elastic strain limit is largely independent of the composition variation. Note that the low processing temperatures are beneficial as they allow for net-shaped casting—which is useful for manufacturing purposes.

TABLE 2

Material Properties of Select BMGMCs as a function of Composition

| name | atomic % | weight % | BMG (%) | bcc (%) | ρ (g/cm$^3$) | $\sigma_y$ (MPa) | $\sigma_{max}$ (MPa) | $\epsilon_y$ (%) | E (GPa) | $T_s$ (K) |
|---|---|---|---|---|---|---|---|---|---|---|
| DV2 | $Ti_{44}Zr_{20}V_{12}Cu_5Be_{19}$ | $Ti_{41.9}Zr_{36.3}V_{12.1}Cu_{6.3}Be_{3.4}$ | 70 | 30 | 5.13 | 1597 | 1614 | 2.1 | 94.5 | 956 |
| DV1 | $Ti_{48}Zr_{20}V_{12}Cu_5Be_{15}$ | $Ti_{44.3}Zr_{35.2}V_{11.8}Cu_{6.1}Be_{2.6}$ | 53 | 47 | 5.15 | 1362 | 1429 | 2.3 | 94.2 | 955 |
| DV3 | $Ti_{56}Zr_{18}V_{10}Cu_4Be_{12}$ | $Ti_{51.6}Zr_{31.6}V_{9.8}Cu_{4.9}Be_{2.1}$ | 46 | 54 | 5.08 | 1308 | 1309 | 2.2 | 84.0 | 951 |
| DV4 | $Ti_{62}Zr_{15}V_{10}Cu_4Be_9$ | $Ti_{57.3}Zr_{26.4}V_{9.8}Cu_{4.9}Be_{1.6}$ | 40 | 60 | 5.03 | 1086 | 1089 | 2.1 | 83.7 | 940 |
| DVAI1 | $Ti_{60}Zr_{16}V_9Cu_3Al_3Be_9$ | $Ti_{55.8}Zr_{28.4}V_{8.9}Cu_{3.7}Al_{1.6}Be_{1.6}$ | 31 | 69 | 4.97 | 1166 | 1189 | 2.0 | 84.2 | 901 |
| DVAI2 | $Ti_{67}Zr_{11}V_{10}Cu_5Al_2Be_5$ | $Ti_{62.4}Zr_{19.5}V_{9.9}Cu_{6.2}Al_1Be_{0.9}$ | 20 | 80 | 4.97 | 990 | 1000 | 2.0 | 78.7 | 998 |
| Ti-6-4a | $Ti_{86.1}Al_{10.3}V_{3.6}$ | $Ti_{90}Al_6V_4$ (Grade 5 Annealed) | na | na | 4.43 | 754 | 882 | 1.0 | 113.8 | 1877 |
| Ti-6-4s | $Ti_{86.1}Al_{10.3}V_{3.6}$ [Ref] | $Ti_{90}Al_6V_4$ (Grade 5 STA) | na | na | 4.43 | 1100 | 1170 | ~1 | 114.0 | 1877 |
| CP-Ti | $Ti_{100}$ | $Ti_{100}$ (Grade 2) | na | na | 4.51 | 380 | 409 | 0.7 | 105.0 | ~1930 |

TABLE 3

Material Properties as a Function of Composition

| Alloy | $\sigma_{max}$ (MPa) | $\epsilon_{tot}$ (%) | $\sigma_y$ (MPa) | $\epsilon_y$ (%) | E (GPa) | ρ (g/cm$^3$) | G (GPa) | CIT (J) | RoA (%) | υ |
|---|---|---|---|---|---|---|---|---|---|---|
| $Zr_{36.6}Ti_{31.4}Nb_7Cu_{5.9}Be_{19.1}$ (DH1) | 1512 | 9.58 | 1474 | 1.98 | 84.3 | 5.6 | 30.7 | 26 | 44 | 0.371 |
| $Zr_{38.3}Ti_{32.9}Nb_{7.3}Cu_{6.2}Be_{15.3}$ (DH2) | 1411 | 10.8 | 1367 | 1.92 | 79.2 | 5.7 | 28.8 | 40 | 50 | 0.373 |
| $Zr_{39.6}Ti_{33.9}Nb_{7.6}Cu_{6.4}Be_{12.5}$ (DH3) | 1210 | 13.10 | 1096 | 1.62 | 75.3 | 5.8 | 27.3 | 45 | 46 | 0.376 |
| $Zr_{41.2}Ti_{13.8}Cu_{12.5}Ni_{10}Be_{22.5}$ (Vitreloy 1) | 1737 | 1.98 | — | — | 97.2 | 6.1 | 35.9 | 8 | 0 | 0.355 |
| $Zr_{56.2}Ti_{13.8}Nb_{5.0}Cu_{6.9}Ni_{5.6}Be_{12.5}$ (LM 2) | 1302 | 5.49 | 1046 | 1.48 | 78.8 | 6.2 | 28.6 | 24 | 22 | 0.375 |

TABLE 4

Material Properties as a Function of Composition and Structure, where A is Amorphous, X, is Crystalline, and C is Composite

| | A/X/C | 2.0 Hv | E (GPa) |
|---|---|---|---|
| (CuZr42Al7Be10)Nb3 | A | 626.5 | 108.5 |
| (CuZr46Al5Y2)Nb3 | A | 407.4 | 76.9 |
| (CuZrAl7Be5)Nb3 | A | 544.4 | 97.8 |
| (CuZrAl7Be7)Nb3 | A | 523.9 | 102.0 |
| Cu40Zr40Al10Be10 | A | 604.3 | 114.2 |
| Cu41Zr40Al7Be7Co5 | C | 589.9 | 103.5 |
| Cu42Zr41Al7Be7Co3 | A | 532.4 | 101.3 |
| Cu47.5Zr48Al4Co0.5 | X | 381.9 | 79.6 |
| Cu47Zr46Al5Y2 | A | 409.8 | 75.3 |
| Cu50Zr50 | X | 325.9 | 81.3 |
| CuZr41Al7Be7Cr3 | A | 575.1 | 106.5 |
| CuZrAl5Be5Y2 | A | 511.1 | 88.5 |
| CuZrAl5Ni3Be4 | A | 504.3 | 95.5 |
| CuZrAl7 | X | 510.5 | 101.4 |
| CuZrAl7Ag7 | C | 496.1 | 90.6 |
| CuZrAl7Ni5 | X | 570.0 | 99.2 |
| Ni40Zr28.5Ti16.5Be15 | C | 715.2 | 128.4 |
| Ni40Zr28.5Ti16.5Cu5Al10 | X | 627.2 | 99.3 |
| Ni40Zr28.5Ti16.5Cu5Be10 | C | 668.2 | 112.0 |
| Ni56Zr17Ti13Si2Sn3Be9 | X | 562.5 | 141.1 |
| Ni57Zr18Ti14Si2Sn3Be6 | X | 637.3 | 139.4 |
| Ti33.18Zr30.51Ni5.33Be22.88Cu8.1 | A | 486.1 | 96.9 |
| Ti40Zr25Be30Cr5 | A | 465.4 | 97.5 |

TABLE 4-continued

Material Properties as a Function of Composition and Structure, where A is Amorphous, X, is Crystalline, and C is Composite

| | A/X/C | 2.0 Hv | E (GPa) |
|---|---|---|---|
| Ti40Zr25Ni8Cu9Be18 | A | 544.4 | 101.1 |
| Ti45Zr16Ni9Cu10Be20 | A | 523.1 | 104.2 |
| Vit 1 | A | 530.4 | 95.2 |
| Vit 105 (Zr52.5Ti5Cu17.9Ni14.6Al10) | A | 474.4 | 88.5 |
| Vit 106 | A | 439.7 | 83.3 |
| Zr55Cu30Al10Ni5 | A | 520.8 | 87.2 |
| Zr65Cu17.5Al7.5Ni10 | A | 463.3 | 116.9 |
| DH1 | C | 391.1 | 84.7 |
| GHDT (Ti30Zr35Cu8.2Be26.8) | A | 461.8 | 90.5 |

Moreover, just as the stiffness of the BMG-based materials can be tuned, the resistance to fatigue failure can also be tuned in accordance with embodiments of the invention. The alloying elements used to improve resistance to fatigue failure is largely experimentally determined. However, the inventors have observed that the same processing techniques that are used to enhance fracture toughness tend to also beneficially influence resistance to fatigue failure.

Tables 5 and 6 below list reported data as to how fatigue characteristics with BMG-based materials vary as a function of composition.

TABLE 5

Fatigue Characteristics as a Function of Composition

| Material | Fracture strength (MPa) | Geometry (mm) | Loading mode[a] | Frequency (Hz) | R-ratio | Fatigue limit (MPa) | Fatigue ratio[b] |
|---|---|---|---|---|---|---|---|
| $Zr_{56.2}Cu_{6.9}Ni_{5.6}Ti_{13.8}Nb_{5.0}Be_{12.5}$ Composites [62] | 1480 | 3 × 3 × 30 | 4PB | 25 | 0.1 | ~296 | 0.200 |
| $Zr_{41.2}Cu_{12.5}Ni_{10}Ti_{13.8}Be_{22.5}$ [49] | 1900 | 3 × 3 × 50 | 4PB | 25 | 0.1 | ~152 | 0.080 |
| $Zr_{41.2}Cu_{12.5}Ni_{10}Ti_{13.8}Be_{22.5}$ [74] | 1900 | 2 × 2 × 60 | 3PB | 10 | 0.1 | 768 | 0.404 |
| $Zr_{41.2}Cu_{12.5}Ni_{10}Ti_{13.8}Be_{22.5}$[74] | 1900 | 2 × 2 × 60 | 3PB | 10 | 0.1 | 359 | 0.189 |

TABLE 5-continued

Fatigue Characteristics as a Function of Composition

| Material | Fracture strength (MPa) | Geometry (mm) | Loading mode[a] | Frequency (Hz) | R-ratio | Fatigue limit (MPa) | Fatigue ratio[b] |
|---|---|---|---|---|---|---|---|
| $Zr_{44}Ti_{11}Ni_{10}Cu_{10}Be_{25}$ [75] | 1900 | 2.3 × 2.0 × 85 | 4PB | 5-20 | 0.3 | 550 | 0.289 |
| $Zr_{44}Ti_{11}Ni_{10}Cu_{10}Be_{25}$ [75] | 1900 | 2.3 × 2.0 × 85 | 4PB | 5-20 | 0.3 | 390 | 0.205 |
| $Zr_{52.5}Cu_{17.9}Al_{10}Ni_{14.6}Ti_5$ [77] | 1700 | 3.5 × 3.5 × 30 | 4PB | 10 | 0.1 | 850 | 0.500 |
| $(Zr_{58}N_{i13.6}Cu_{18}Al_{10.4})_{99}Nb_1$ [76] | 1700 | 2 × 2 × 25 | 4PB | 10 | 0.1 | 559 | 0.329 |
| $Zr_{55}Cu_{30}Ni_5Al_{10}$ [78] | 1560 | 2 × 20 × 50 | Plate bend | 40 | 0.1 | 410 | 0.263 |

TABLE 6

Fatigue Characteristics as a Function of Composition

| Material | Fracture strength (MPa) | Geometry (mm) | Loading mode[a] | Frequency (Hz) | R-ratio | Fatigue limit (MPa) | Fatigue ratio |
|---|---|---|---|---|---|---|---|
| $Zr_{56.2}Cu_{6.9}Ni_{5.6}Ti_{13.8}Nb_{5.0}Be_{12.5}$ Composites [56] | 1480 | ϕ2.98 | TT | 10 | 0.1 | 239 | 0.161 |
| $Zr_{55}Cu_{30}Al_{10}Ni_5$Nano [85] | 1700 | 2 × 4 × 70 | TT | 10 | 0.1 | ~340 | 0.200 |
| $Zr_{41.2}Cu_{12.5}Nb_{10}Ti_{13.8}Be_{22.5}$ [55] | 1850 | ϕ2.98 | TT | 10 | 0.1 | 703 | 0.380 |
| $Zr_{41.2}Cu_{12.5}Nb_{10}Ti_{13.8}Be_{22.5}$ [55] | 1850 | ϕ2.98 | TT | 10 | 0.1 | 615 | 0.332 |
| $Zr_{41.2}Cu_{12.5}Nb_{10}Ti_{13.8}Be_{22.5}$ [56] | 1850 | ϕ2.98 | TT | 10 | 0.1 | 567 | 0.306 |
| $Zr_{41.2}Cu_{12.5}Nb_{10}Ti_{13.8}Be_{22.5}$ [80] | 1900 | — | CC | 5 | 0.1 | ~1050 | 0.553 |
| $Zr_{41.2}Cu_{12.5}Nb_{10}Ti_{13.8}Be_{22.5}$ [80] | 1900 | — | TC | 5 | -1 | ~150 | 0.079 |
| $Zr_{50}Cu_{40}Al_{10}$ [53] | 1821 | ϕ2.98 | TT | 10 | 0.1 | 752 | 0.413 |
| $Zr_{50}Cu_{30}Al_{10}Ni_{10}$ [53] | 1900 | ϕ2.98 | TT | 10 | 0.1 | 865 | 0.455 |
| $Zr_{50}Cu_{37}Al_{10}Pd_3$ [57] | 1899 | ϕ2.98 | TT | 10 | 0.1 | 983 | 0.518 |
| $Zr_{50}Cu_{37}Al_{10}Pd_3$ [81] | 1899 | ϕ5.33 | TT | 10 | 0.1 | ~900 | 0.474 |
| $Zr_{52.5}Cu_{17.9}Al_{10}Ni_{14.6}Ti_5$ [82] | 1660 | 6 × 3 × 1.5 | TT | 1 | 0.1 | — | — |
| $Zr_{52.5}Cu_{17.9}Al_{10}Ni_{14.6}Ti_5$ [51] | 1700 | ϕ2.98 | TT | 10 | 0.1 | 907 | 0.534 |
| $Zr_{59}Cu_{20}Al_{10}Ni_8Ti_3$ [82] | 1580 | 6 × 3 × 1.5 | TT | 1 | 0.1 | — | — |
| $Zr_{65}Cu_{15}Al_{10}Ni_{10}$ [84] | 1300 | 3 × 4 × 16 | TT | 20 | 0.1 | ~280 | 0.215 |
| $Zr_{55}Cu_{30}Al_{10}Ni_5$ [83] | 1560 | 1 × 2 × 5 | TT | .13 | 0.5 | — | — |

Although this data has been reported, the Inventors note that this data is in conflict with their own results. Indeed through their own testing, the Inventors have identified particular compositions and families of compositions that are particularly suitable for the design, manufacture, and implementation of compliant mechanisms. This is now discussed below.

Compositions that are Particularly Suitable for Compliant Mechanisms

Figure 6:
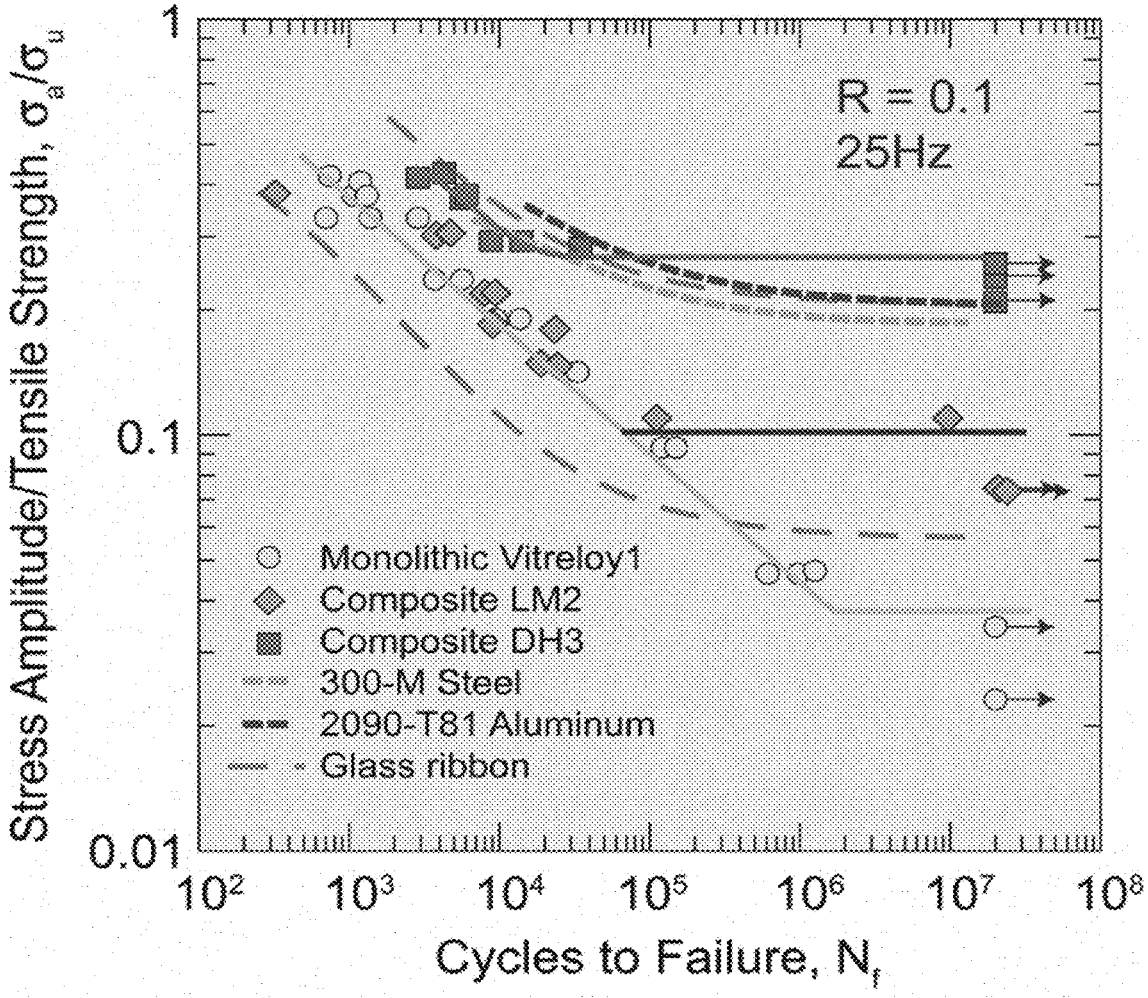
FIG. 6 illustrates a plot of the resistance to fatigue failure of several BMG-based materials.
Figure 7:
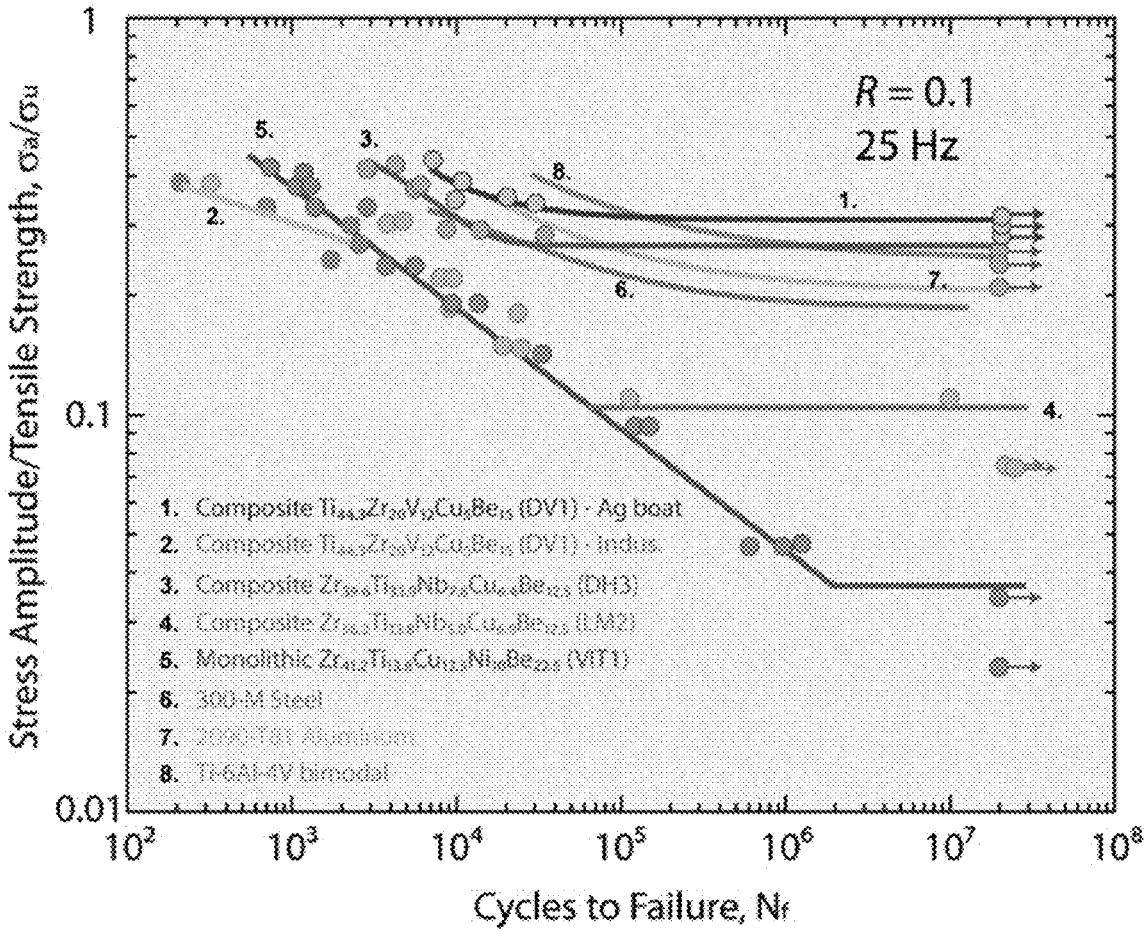
FIG. 7 illustrates a plot of the resistance to fatigue failure of several BMG-based materials.

The Inventors conducted their own fatigue tests (under ASTM stress-life [S-N] testing parameters), and the results of the test are depicted in FIGS. 6 and 7.

In particular, FIG. 6 illustrates the fatigue resistance of Monolithic Vitreloy1, Composite LM2, Composite DH3, 300-M Steel, 2090-T81 Aluminum, and Glass Ribbon. From these results, it is demonstrated that Composite DH3 exhibits a high resistance to fatigue failure. For example, Composite DH3 shows that it can survive approximately 20,000,000 cycles at a stress amplitude/tensile strength ratio of about 0.25. Note that monolithic Vitreloy 1 shows relatively poor resistance to fatigue failure, which appears to contravene the results shown in Tables 5 and 6. This discrepancy may be in part due to the rigor under which the data was obtained. In particular, as the Inventors have realized that resistance to fatigue is a critical material property in determining suitability for compliant mechanism applications, they obtained fatigue resistance data that was procured under the most stringent testing conditions. In particular, FIG. 6 was obtained from Launey, PNAS, Vol. 106, No. 13, 4986-4991, the disclosure of which is hereby incorporated by reference (and of which the one of the instant Inventors is a listed coauthor).

Similarly, FIG. 7 illustrates the fatigue resistance of DV1 ('Ag boat'—i.e., manufactured using semisolid processing), DV1 ('indus.'—manufactured using industry standard procedures), Composite DH3, Composite LM2, Monolithic Vitreloy1, 300-M Steel, 2090-T81 Aluminum, and Ti-6Al-4V bimodal. These results indicate that Composite DV1 (Ag boat) exhibits even greater resistance to fatigue failure than Composite DH3. Note that the results of the Composite DV1 testing varied greatly based on how the Composite DV1 was manufactured. When it was manufactured using 'Ag boat' techniques ('Ag boat' refers to semisolid manufacturing techniques, which are described in Hofmann, JOM, Vol. 61, No. 12, 11-17, the disclosure of which is hereby incorporated by reference.), it displayed far superior resistance to fatigue as compared to when it was manufactured using industry standard techniques. The inventors believe that this discrepancy is due to the fact that industry standard manufacturing processes do not provide the type of rigor necessary to produce sufficiently pure materials, and this may be a function of the industry not recognizing how critical material composition is in determining material properties, including resistance to fatigue failure.

Figure 8:
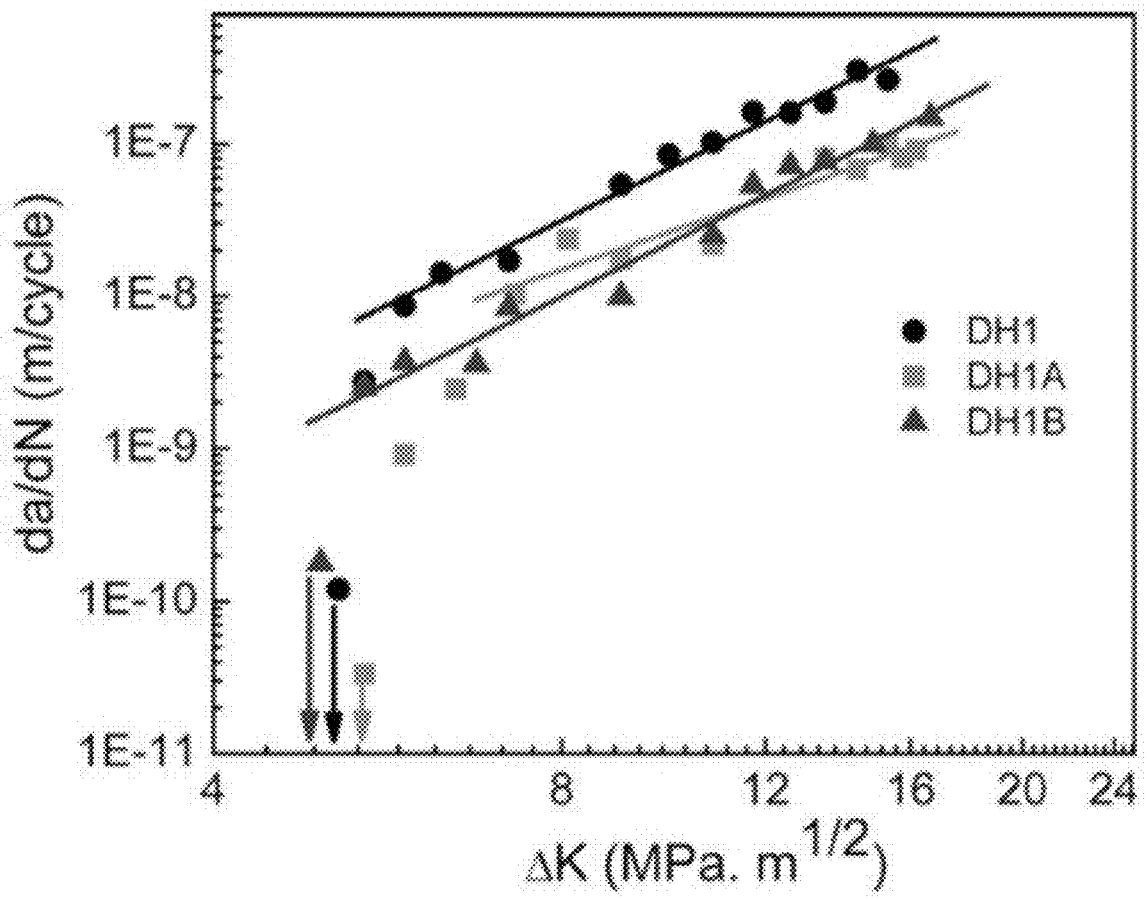
FIG. 8 illustrates a plot that shows the variation of crack growth rate under cycling as a function of the applied stress intensity factor range for DH1 Composites.
Figure 9:
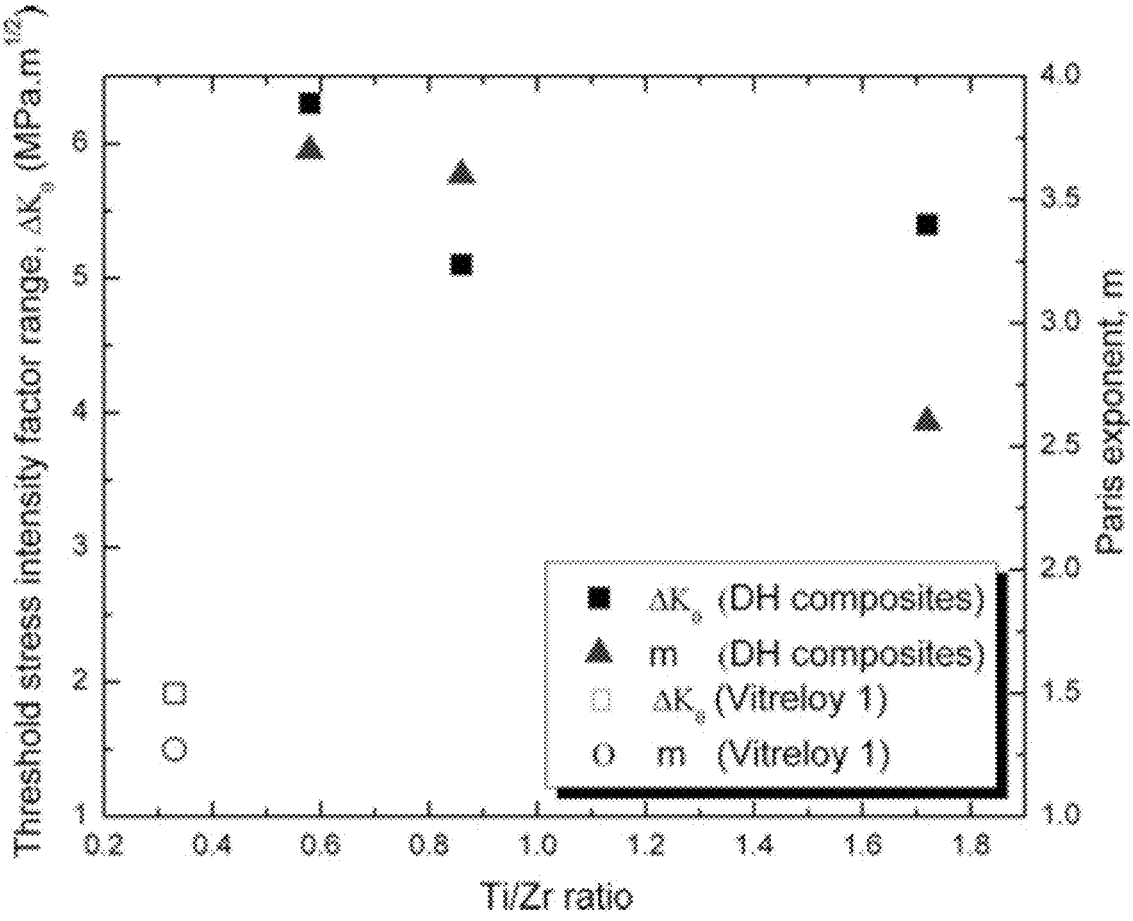
FIG. 9 illustrates the variation of the stress intensity factor range for fatigue crack growth and the Paris exponent as a function of Ti/Zr ratio for DH Composites as well as for Vitreloy 1.

The inventors also provide FIGS. 8 and 9 as an illustration of the fatigue resistance of DH1 composites. In particular, FIG. 8 depicts the variation of the crack growth rate of DH1 composites under cyclic loading as a function of the applied stress factor range, K. The arrows in the lower left indicate the threshold values. FIG. 9 provides depicts the threshold stress intensity factor range for fatigue crack growth, $\Delta K_0$, and the Paris exponent, m, plotted as a function of the Ti/Zr ratio; Vitreloy 1 is also plotted for comparative purposes.

Table 7, below also provides data regarding the fatigue resistance of DH1 composites.

TABLE 7

Fatigue Crack Growth Parameters and Densities

| Material | $\Delta K_0$ (MPa · $m^{1/2}$) | m | C(MPa · $m^{1/2}$) | Density ($g/cm^3$) |
|---|---|---|---|---|
| DH1 composite | 5.0 | 3.5 | $1.5 \times 10^{-11}$ | 5.58 |
| DH1A composite | 5.4 | 2.4 | $5.9 \times 10^{-11}$ | 5.43 |
| DH1B composite | 5.7 | 3.5 | $1.5 \times 10^{-11}$ | 5.85 |
| Vitreloy 1[2] | 1-3 | 2.7-4.9 | $1.5 \times 10^{-11}$ – $1.6 \times 10^{-11}$ | 6.05 |
| Vitreloy 1[25] | 1.5 | 1.5 | . . . | 6.05 |
| Vitreloy 1 composite (LM2)[18] | 1.2 | 1.8 | . . . | . . . |
| 300-M Steel[2] | 3 | 2-4 | . . . | 7.9 |
| 2090-T81 Al alloys[2] | 2.1 | 2-4 | . . . | 2.7 |

$\Delta K_0$, threshold stress intensity factor range for fatigue crack initiation;
m, Paris exponent.

Accordingly, in view of this information, the Inventors have observed that DH composites would also serve as suitable materials from which to form compliant mechanisms. Note that FIGS. 8, 9, and Table 7 were obtained from Boopathy, J. Mater. Res. Vo. 24, No. 12, December 2009, the disclosure of which is hereby incorporated by reference (and of which one of the instant Inventors is a listed coauthor).

Accordingly, in many embodiments of the invention, a compliant mechanism is fabricated from one of: Composite DV1 (Ag boat), Composite DV1 (Indus.), Composite DH3, Composite LM2, Composite DH1, Composite DH1A, Composite DH1 B, and Vitreloy.

Additionally, the Inventors have further observed that, generally, ZrTiBe based BMG Composites with additives to improve glass forming ability and ductility, are well suited for compliant mechanism applications. In many embodiments, a compliant mechanism may be formed from a TiZrBeXY BMGMC where X is an additive that is used to enhance glass forming ability, and Y is an additive added for toughness.

In many embodiments, Ti is between approximately 10 and 60 atomic %; Zr is between 18 and 60 atomic %; and Be is between approximately 7 and 30 atomic %.

In a number of embodiments, X is one of: Fe, Cr, Co, Ni, Cu, Al, B, C, Al, Ag, Si, and mixtures thereof. The inventors have observed that: where C, Si, or B is the additive, it is generally preferable that the additive be added in an amount less than 2 atomic %; where Cr, Co, or Fe is the additive, it is generally preferable that the additive be added in an amount less than 7 atomic %; where Al is the additive, it is generally preferable to have it added in an amount less than 10 atomic %; and where Cu and Ni are the additives, it is generally preferable that one or both be added in an amount less than 20 atomic % (in combination). Additionally, it may be preferred that the combination of the atomic percentages of Be and X should be less than 30%, otherwise a BMG is formed and not a BMGMC—BMGMCs are preferable in many instances. For example, in many cases BMGMCs will plastically yield before they rupture; conversely, many BMG materials tend to rupture prior to noticeable yielding. Generally, the crystals that are present within BMGMCs increase their ductility. In many embodiments where BMGMC materials are used, the volume fraction of crystals ranges from 20-80%. Of course, the crystals can be present in any amount in accordance with embodiments of the invention, for example between approximately 5 and 95%. Indeed, any suitable BMGMCs can be used. On the whole, the Inventors have observed that BMGMCs are very well-suited for compliant mechanism applications, as they exhibit noteworthy resistance to fatigue. Of course, in many embodiments, compliant mechanisms are formed from monolithic BMG materials.

In many embodiments, Y is one of: V, Nb, Ta, Mo, Sn, W and mixtures thereof. Generally, these elements can be considered as 'beta stabilizers' and they make the dendrites softer and the alloy tougher. The inventors have generally observed that: where V is the additive, it is generally preferable that it be added in an amount less than 15 atomic %; where Nb is the additive, it is generally preferable that it be added in an amount between approximately 5 and 15 atomic %; where Ta is the additive, it is generally preferable that it be added in an amount less than 10 atomic %; where Mo is the additive, it is generally preferable that it be added in an amount less than 5 atomic %; and where Sn is the additive, it is generally preferable that it be added in an amount less than 2 atomic %.

Thus, in many embodiments, a compliant mechanism is fabricated from a BMGMC in accordance with the above-described compositions. The Inventors note that any of a variety of compliant mechanism designs can benefit from being formed from BMG-based materials, and some examples are discussed below.

Examples of Compliant Mechanisms that can be Formed from BMG-Based Materials

Of course any number of compliant mechanisms can be formed from BMG-based materials in accordance with embodiments of the invention. Some illustrative examples are discussed below.

In some embodiments, a bistable mechanism is formed from a BMG-based material. A bistable mechanism is a type of compliant mechanism that uses elastic deformation to allow the mechanism to be stable in at least two configurations. Bistable mechanisms may be extremely useful for the storage of elastic strain energy that can later be released through actuation. This may include devices like switches or devices that can be used to deploy another component. Generally, in many instances, bistable mechanisms implement flexible members that, when strained, exert counteracting forces, and thereby allow the bistable mechanism to adopt multiple stable configurations.

Bistable mechanisms fabricated from BMG-based materials can be particularly advantageous as BMG-based materials can store relatively more strain energy than many other materials that are commonly used to form compliant mechanisms.

Figure 10:
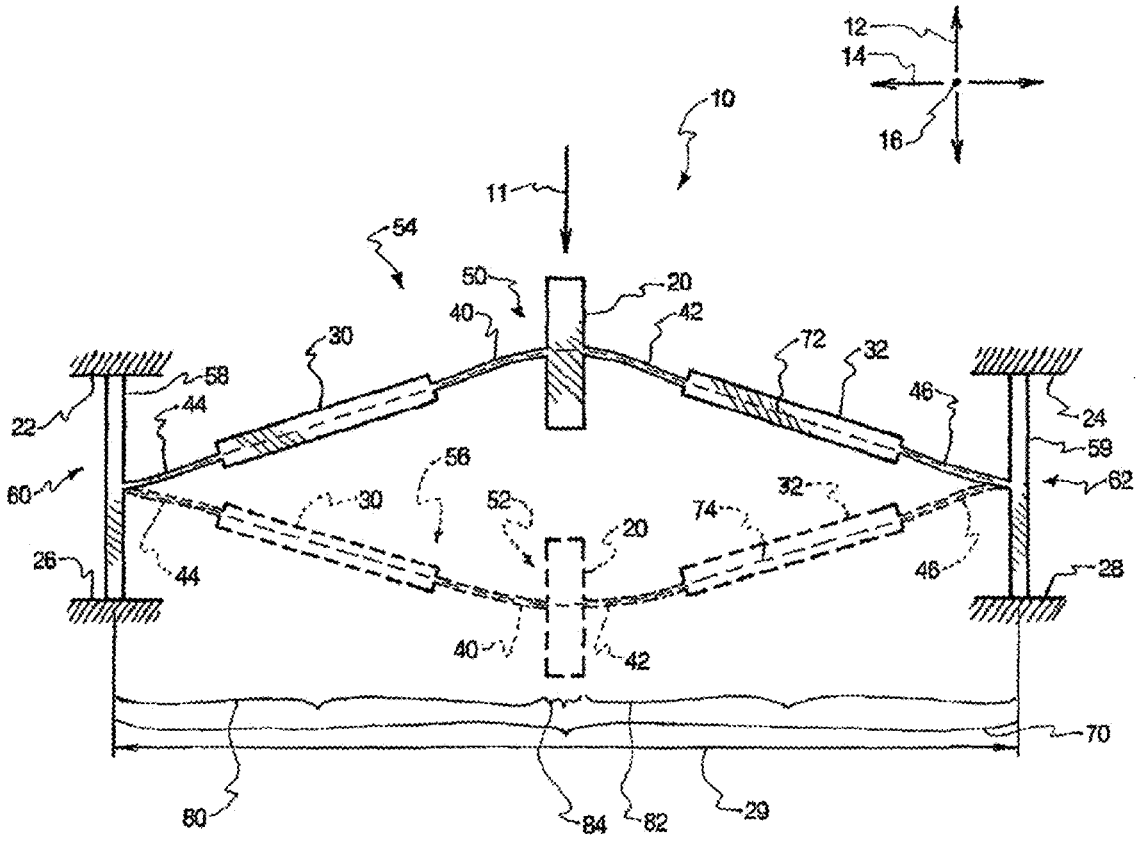
FIG. 10 illustrates a bistable mechanism that can be formed from BMG-based materials in accordance with embodiments of the invention.
Figure 11A:
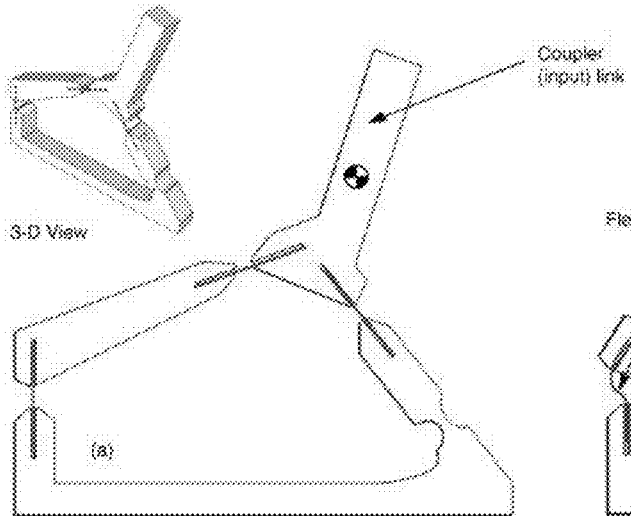
FIGS. 11A-11B illustrate a bistable mechanism that can be formed from BMG-based materials in accordance with embodiments of the invention.
Figure 11B:
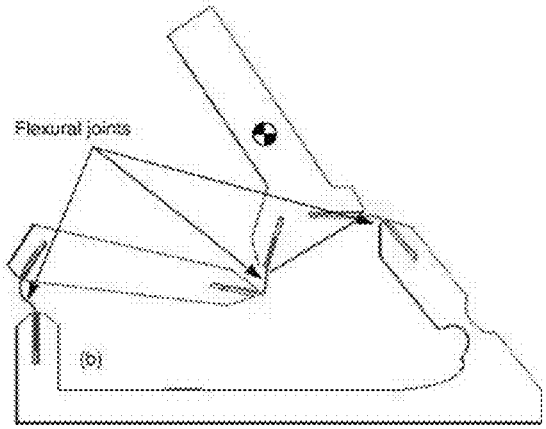
Figure 12A:
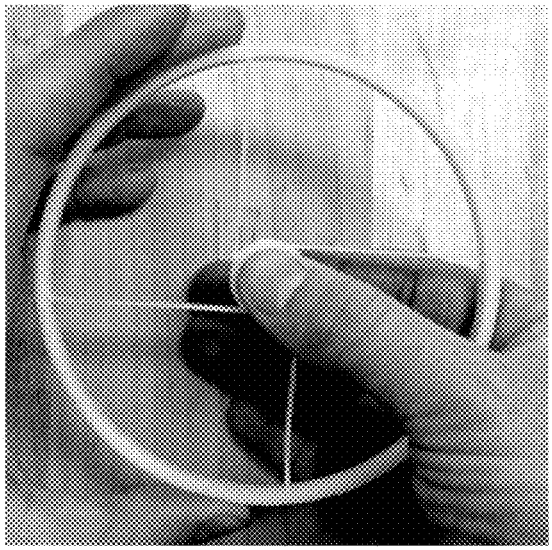
FIGS. 12A-12B illustrate a bistable mechanism that can be formed from BMG-based materials in accordance with embodiments of the invention.
Figure 12B:
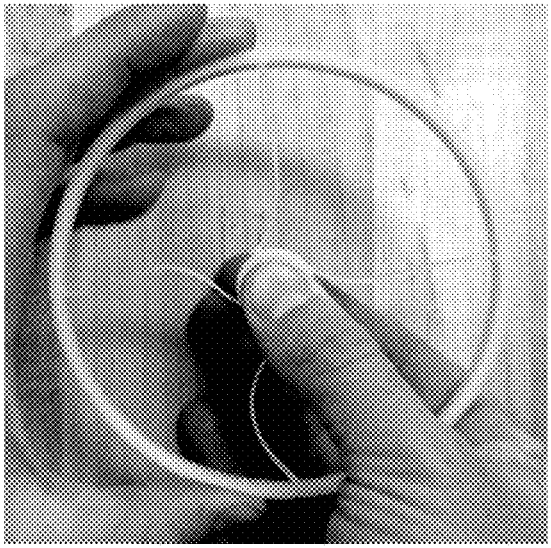

There exists many designs for bistable mechanisms, and any of them can of course be formed form a BMG-based material in accordance with embodiments of the invention. One example of a bistable mechanism is illustrated in FIG. 10, and is obtained from U.S. Pat. No. 7,075,209, the disclosure of which is hereby incorporated by reference. FIGS. 11A-11B illustrate another bistable mechanism that can be formed from BMG-based materials in accordance with embodiments of the invention. In particular, FIGS. 11A and 11B depict the bistable mechanism in each of two stable states. Finally, FIGS. 12A and 12B illustrate yet another bistable mechanism that can be formed from BMG-based materials in accordance with embodiments of the invention. Again, FIGS. 12A and 12B depict the bistable mechanism in each of two stable states. Note that each of the three illustrated bistable mechanisms relies on its constituent members ability to strain in order to function.

Of course any bistable mechanism can be formed from a BMG-based material in accordance with embodiments of the invention, not just the ones illustrated. Indeed, any of a variety of compliant mechanisms can be formed from BMG-based materials in accordance with embodiments of the invention.

For example, in some embodiments, compliant mechanisms for precision pointing applications (e.g. for use in optics) are fabricated from BMG-based materials. Generally, precision pointing applications require an actuation force that causes the elastic deformation of the flexural components. Forming such compliant mechanisms from BMG-based materials can be advantageous as BMG-based materials have relatively higher strength to stiffness ratios than many other metals; thus, BMG-based materials can result in designs that have relatively larger ranges of flexing for a fixed geometry, or alternatively a smaller size for a fixed force.

Figure 13A:
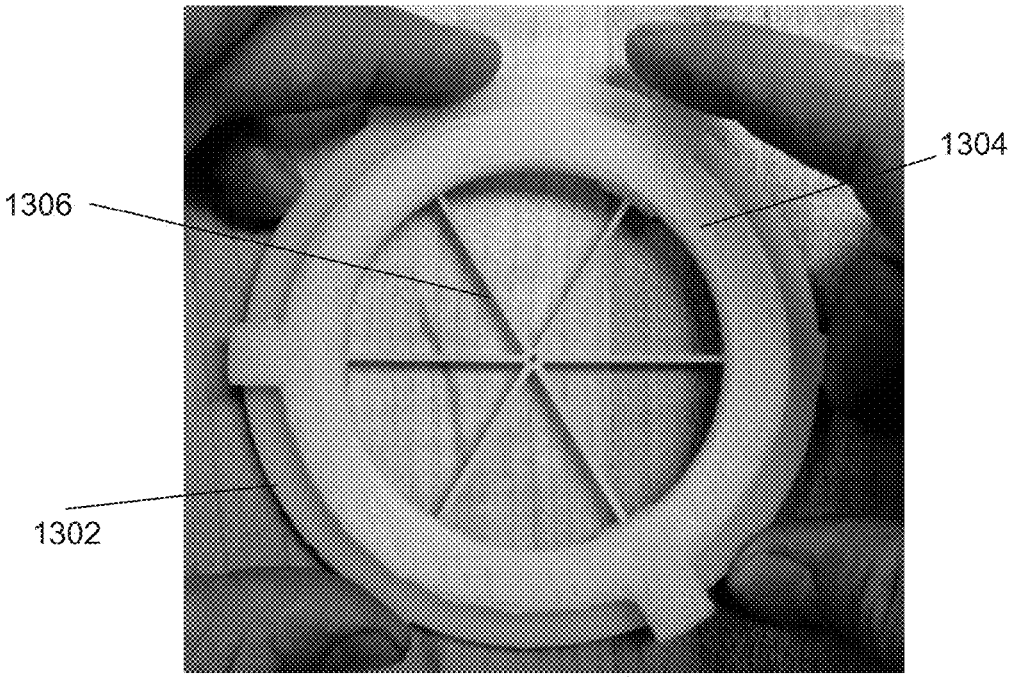
FIGS. 13A-13B illustrate a rotational hexfoil flexure design that can be formed from a BMG-based material in accordance with embodiments of the invention.
Figure 13B:
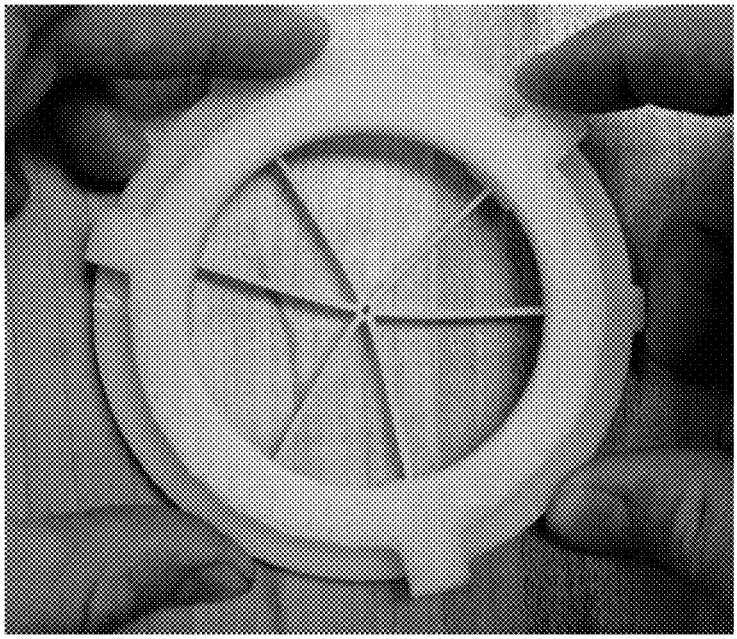

FIGS. 13A-13B depict a rotational hexfoil flexure that can be used as a precision pointing tool, and that may be fabricated from BMG-based materials in accordance with embodiments of the invention. In particular, FIG. 13A illustrates a rotational hexfoil flexure design that is fabricated from a monolithic polymer. The design generally includes a base cylindrical portion, and an overlaid cylindrical portion. The design further includes 3 equally spaced beams that each substantially span the diameter of the base cylindrical portion, except that they do not entirely span the diameter of the base cylindrical portion. Accordingly, the beams are adjoined to the base cylindrical portion at one end, and are not adjoined to the base cylindrical portion at the opposite end. The overlaid cylindrical portion is affixed to the free end of the beams of the beams and can thereby rotate relative to the base cylindrical portion when actuated. FIG. 13B illustrates the operation of the rotational hexfoil flexure, i.e. how the overlaid cylindrical portion is rotated relative to the base cylindrical portion when actuated. It should be noted that the mechanism depicted in FIGS. 13A and 13B can be fabricated as a single piece with one end of the beam adjoined to the base cylindrical portion and the other end of the beam adjoined to the overlaid cylindrical portion.

Figure 14A:
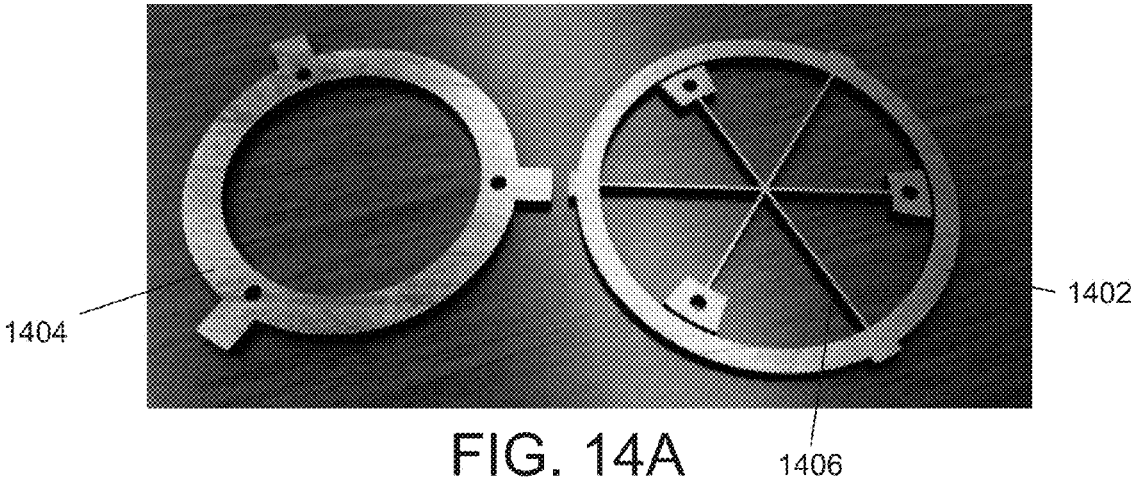
FIGS. 14A-14C illustrate a rotational hexfoil flexure that was formed from a BMG-based material in accordance with embodiments of the invention.
Figure 14B:
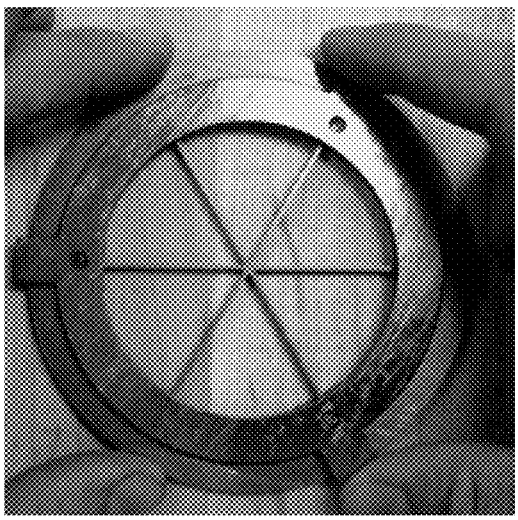
Figure 14C:
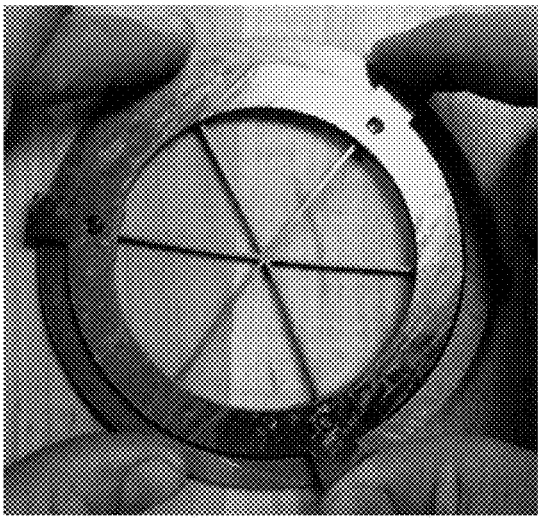

FIGS. 14A-14C illustrate an equivalent rotational hexfoil fabricated from a BMG-based material. In particular, FIG. 14A illustrates that the rotational hexfoil is fabricated from a two separate pieces, the base cylindrical portion 1402 and the overlaid cylindrical portion 1404. FIG. 14A also more clearly illustrates that the base cylindrical portion 1402 includes three beams 1406 that substantially span the diameter of the base cylindrical portion, but are only attached to the base cylindrical portion at one end. The pieces are subsequently adjoined to form the rotational hexfoil. In particular the opposite ends of the beams 1406 are adjoined to the overlaid cylindrical portion. Of course the pieces can be adjoined using any suitable method in accordance with embodiments of the invention. For example, they can be assembled using pins, and the pins may or may not be made from BMG-based materials. Additionally, the adjoining can be done through press fitting, welding, screwing, bolting, bonding, or through capacitive discharge in accordance with embodiment of the invention. In many embodiments, the same material is used so that the coefficient of thermal expansion is the same throughout the device. FIGS. 14B and 14C illustrate the operation of the rotational hexfoil flexure. FIG. 14B illustrates the hexfoil in its relaxed state, whereas FIG. 14C illustrates the hexfoil in its rotated strained state. Of course, although a particular rotational flexure is illustrated as a prospective pointing tool in FIGS. 13A-B, and 14A-C, any rotational flexure can be implemented using BMG-based materials in accordance with embodiments of the invention. For example, rotational flexures that include more than 3 beams may be implemented. Indeed any precision pointing tools that are compliant mechanisms can be implemented using BMG-based materials in accordance with embodiments of the invention.

Figure 15:
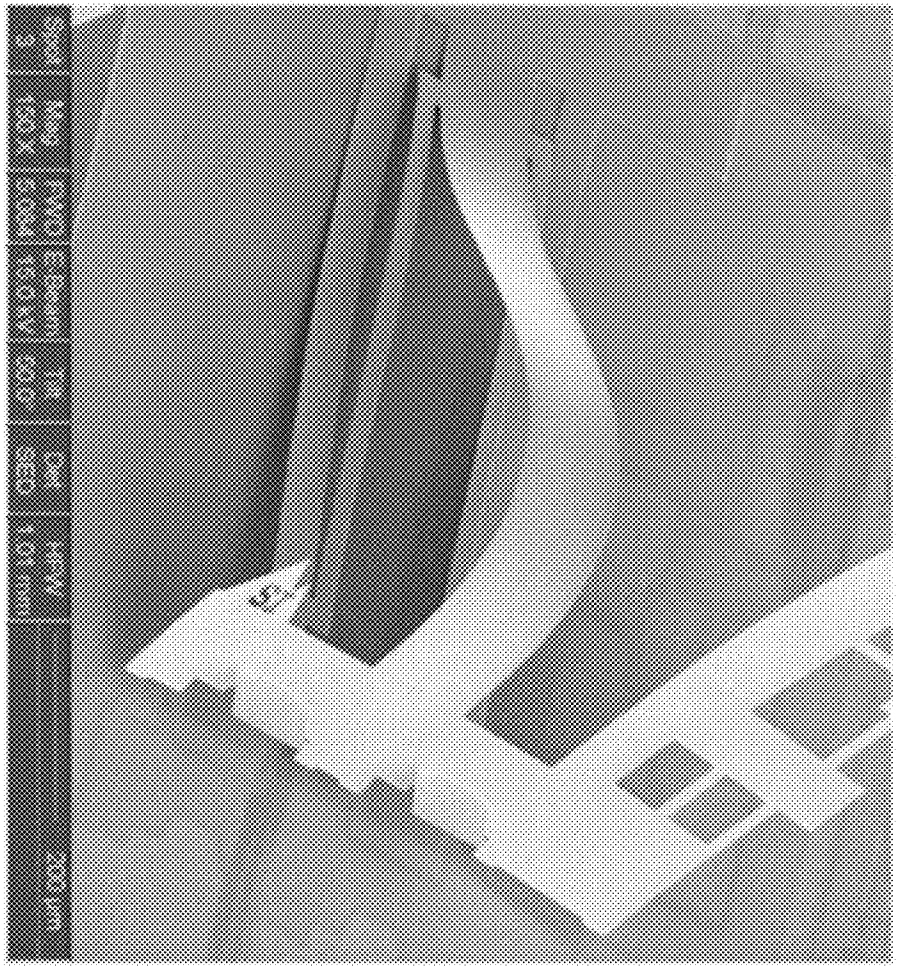
FIG. 15 illustrates the pliability/formability of a sheet of BMG-based material.

Note that BMG-based materials are sufficiently amenable to the above-listed adjoining processes. More generally, in accordance with embodiments of the invention, BMG-based materials can be formed into sheets of material, which can easily be manipulated to fabricated structures. For example, BMG-based materials can be made into sheet-like forms, and can be cut, bent, stacked, welded, pinned, or otherwise assembled into a mechanism. In particular, sheets of BMG-based materials are easy to weld together and can be cut easily using waterjet cutting, EDM, laser cutting, etc. FIG. 15 illustrates the pliability and formability of a sheet of a BMG-based material.

The compliant scissors depicted in FIG. 2B may also be formed form BMG-based materials in accordance with embodiments of the invention. Indeed, as should be evident from the discussion thus far, any number of compliant mechanism designs can be formed from BMG-based materials in accordance with embodiments of the invention. For instance, any of the compliant mechanism designs disclosed in Hale, L. C., Principles and Techniques for Designing Precision Machines, Ph. D. Thesis, M.I.T., February 1999, the disclosure of which is hereby incorporated by reference, can be fabricated from BMG-based materials in accordance with embodiments of the invention.

As should evident from the above discussion, compliant mechanisms can be formed from any number of BMG-based materials in accordance with embodiments of the invention. As further discussed above, the particular BMG-based material that is selected for fabrication can be based on the desired design parameters. For example, the design requirements for a particular rotational hexfoil flexure may require that it be able to survive at least 100 cycles of an applied bending load at 50% of the total elastic strain limit. Accordingly, an appropriate BMG-based material that meets this criterion may be selected from which to fabricate the compliant mechanism.

The Inventors have further observed that it many instances it may be beneficial to manufacture compliant mechanisms from BMGMCs using particular manufacturing techniques, and this is now discussed below.

Methods for Fabricating BMGMC-Based Compliant Mechanisms

In many cases, the relatively higher viscosities of BMGMCs impacts their ability to be serve as materials from which compliant mechanisms can be fabricated. Accordingly, the manufacture of compliant mechanisms from BMGMCs can benefit from tailored manufacturing methodologies. In particular, in many embodiments, compliant mechanisms are formed from BMGMCs using squeeze-casting techniques. Squeeze-casting is often utilized in the formation of plastic parts; however, many BMGMCs have a similarly viscous texture and are thereby amenable to such manufacturing techniques.

Figure 16:
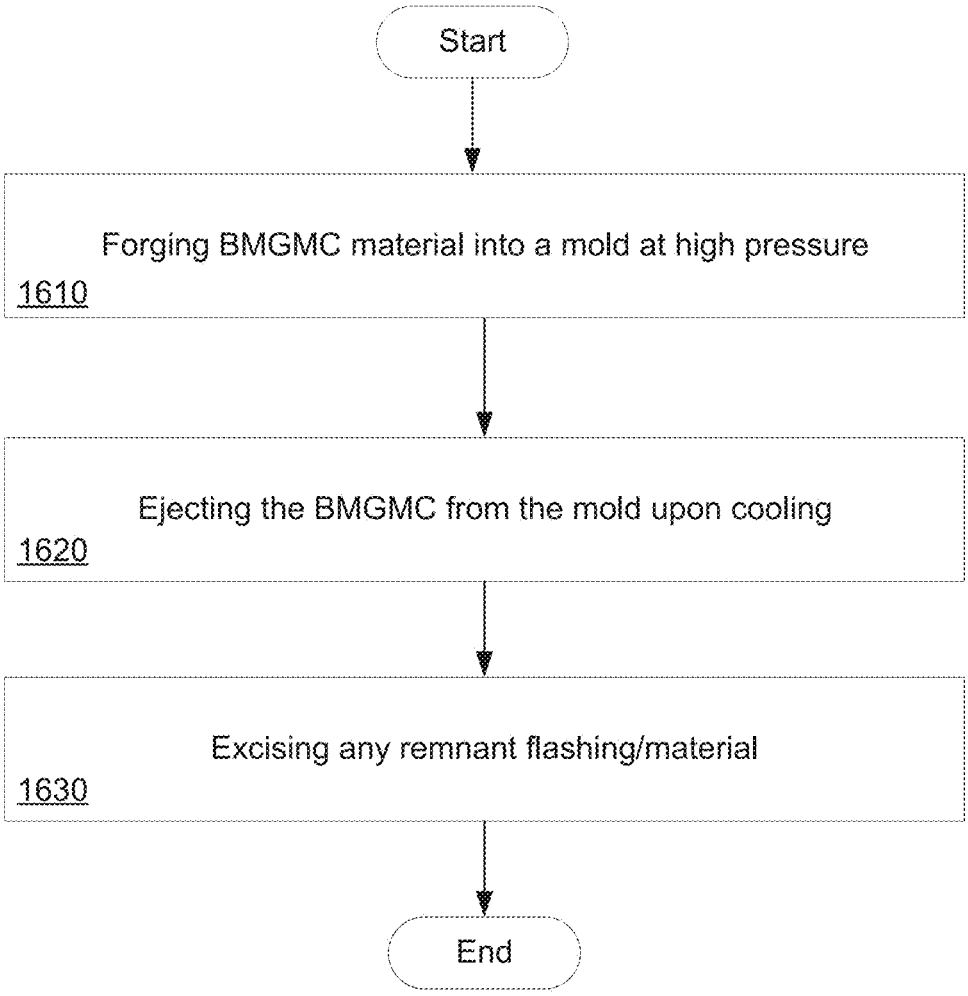
FIG. 16 illustrates a method of forming a BMGMC-based compliant mechanism.

A method of fabricating a BMGMC-based macroscale compliant mechanism that includes forging a BMGMC material into a mold at high pressure, ejecting the BMGMC material from the mold upon cooling, and excising any remnant flashing or remnant material is illustrated in FIG. 16. In particular, a BMGMC material is forged (1610) into a mold at high pressure. The mold can be in the shape of the compliant mechanism to be formed; or it can be in the shape of a portion of the compliant mechanism to be formed. The BMGMC material can be one that has demonstrated a sufficient resistance to fatigue failure, and that can also satisfy the design parameters for the compliant mechanism. The BMGMC material is ejected (1620) from the mold upon cooling. In many instances, it is not desirable to have a draft angle in the compliant mechanism that would facilitate the release of the material from the mold. Accordingly, in many instances, a two-piece mold is used that can facilitate the release. Moreover, in many instances, removing the BMGMC from the mold involves using a punching tool. The punching tool may be of the same shape as the part to be formed. The inventors have observed that steel punching tools are often sufficient and well-suited to remove the part from the mold. Moreover, the punching tools that can be used can be 'through-the-thickness' punching tools, i.e. they have a thickness that mirrors the depth of the mold, and can therefore punch the part 'through the thickness' of the mold. Notably, in removing the compliant mechanism in this way, the mechanism does not have to have relief angles as are typically added to free BMG-based materials from molds. Any remnant flashing/material is then excised (1630). If the result is a portion of the compliant mechanism, it may then be assembled to complete the compliant mechanism. This assembly can involve the adjoining of components using, for example, one of: welding, capacitive discharge, bolts, screws, pins, and mixtures thereof.

Figure 17A:
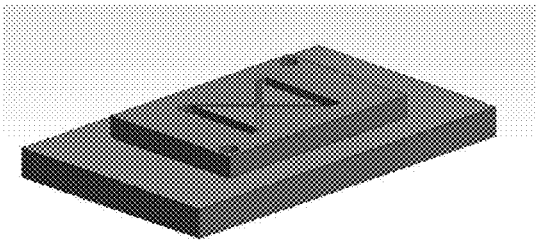
FIGS. 17A-17D illustrate the formation of a cartwheel compliant mechanism using squeeze casting techniques in accordance with embodiments of the invention.
Figure 17B:
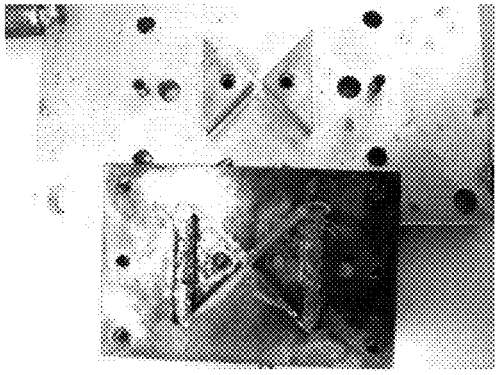
Figure 17C:
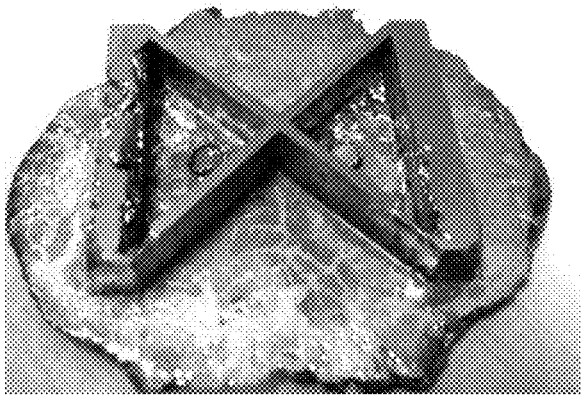
Figure 17D:
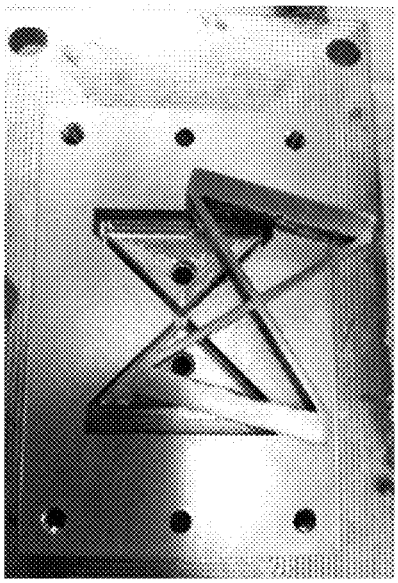

FIGS. 17A-17D illustrate the formation of a cartwheel compliant mechanism using squeeze casting techniques in accordance with embodiments of the invention. In particular, FIG. 17A illustrates the mold that was used to form the cartwheel flexure. FIG. 17B illustrates the BMGMC-based material that was squeeze-cast into the mold, as it was removed from the mold. FIG. 17C depicts the flashing that accompanied the BMGMC-based material as it was removed from the mold. And FIG. 17D depicts the cartwheel flexure in its final form relative to the mold.

Figure 18A:
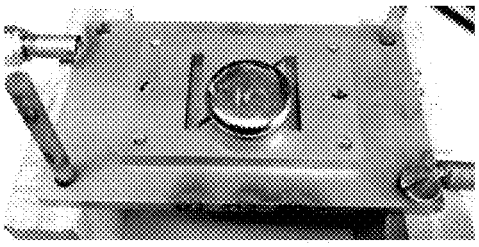
FIGS. 18A-18E illustrate the formation of a member of a cross-blade compliant mechanism using squeeze-casting techniques in accordance with embodiments of the invention.
Figure 18B:
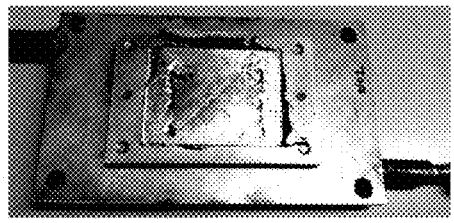
Figure 18C:
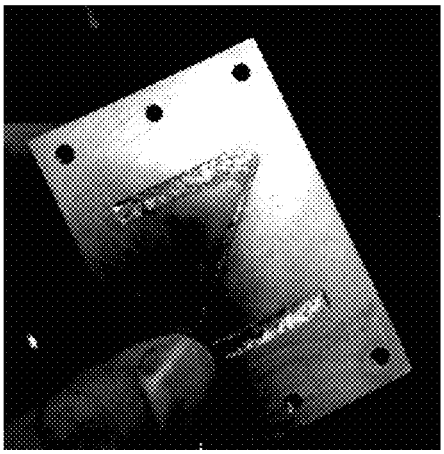
Figure 18D:
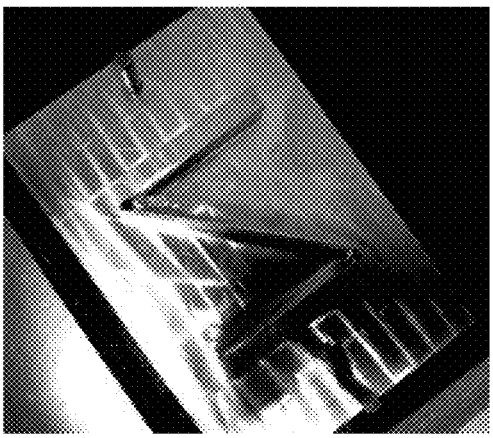
Figure 18E:
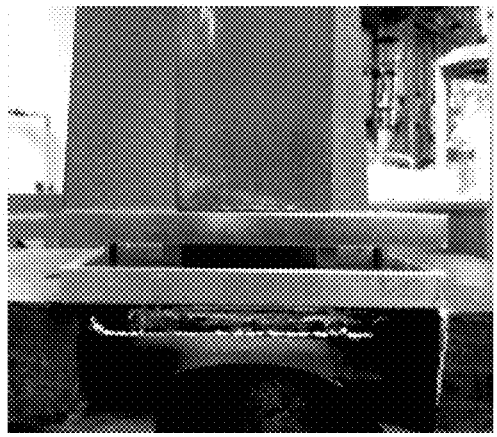

Similarly, FIGS. 18A-18E illustrate the formation of a member of a cross-blade compliant mechanism using squeeze-casting techniques in accordance with embodiments of the invention. In particular, FIG. 18A illustrates a DV1 BMGMC ingot prior to being squeeze cast into a Z-shaped mold. FIG. 18B illustrates the DV1 BMGMC as it has been squeeze-cast into the mold. FIG. 18C illustrates the DV1 BMGMC as it has been removed from the mold. FIG. 18D illustrates a steel punching tool that can be used to separate the Z-shaped part from the excess material. And FIG. 18E illustrates the use of that tool to separate the part.

Note that to complete the cross-blade flexure, two z-shaped BMGMC-based compliant mechanisms must be adjoined. They can be adjoined in any suitable way in accordance with embodiments of the invention. For example, they can be adjoined using one of: welding, capacitive discharge, bolts, screws, pins, and mixtures thereof.

Figure 19:
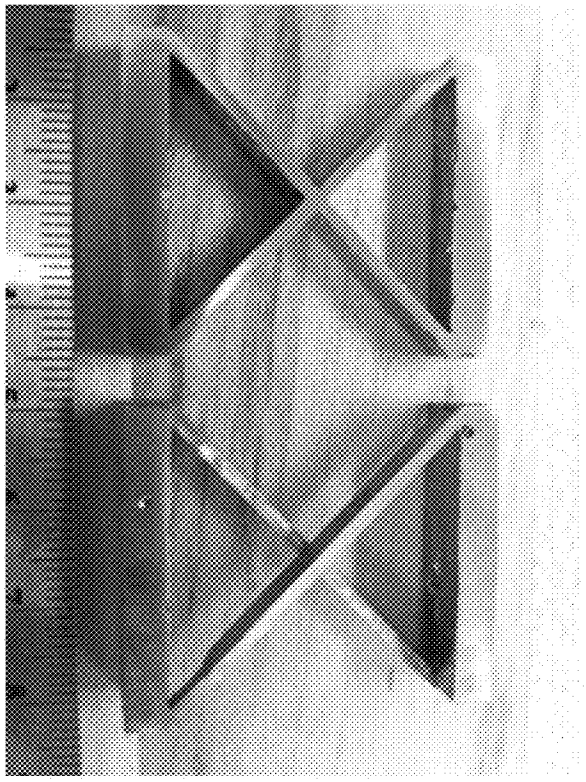
FIG. 19 illustrates the cartwheel compliant mechanism and the crossblade compliant mechanism that were fabricated using squeeze-casting techniques in accordance with embodiments of the invention.

FIG. 19 illustrates the cartwheel compliant mechanism and the crossblade compliant mechanism that were fabricated from the BMGMC, DV1, using squeeze-casting techniques.

Figure 20A:
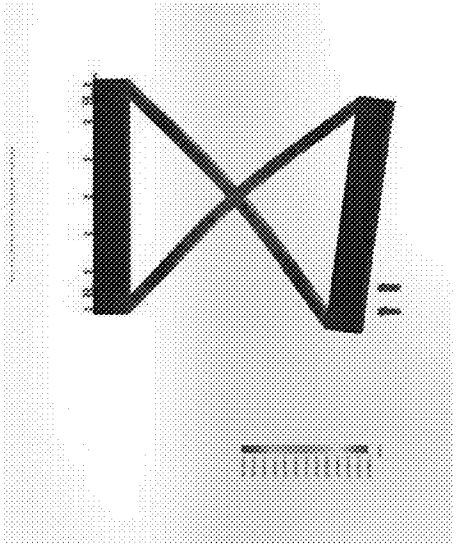
FIGS. 20A-20B illustrate how steel-based cartwheel flexures compare with BMGMC-based cartwheel flexures in accordance with embodiments of the invention.
Figure 20B:
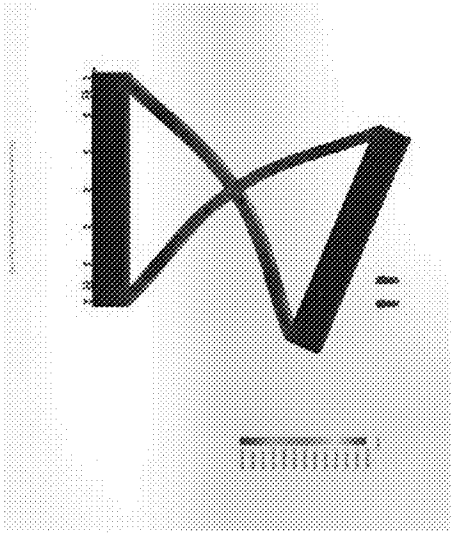
Figure 21A:
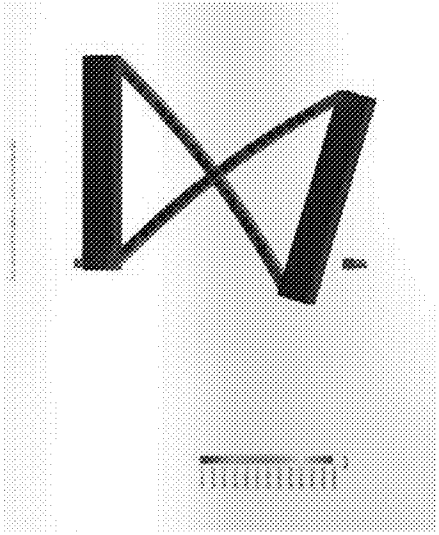
FIGS. 21A-21B illustrate how steel-based crossblade flexures compare with BMGMC-based crossblade flexures in accordance with embodiments of the invention.
Figure 21B:
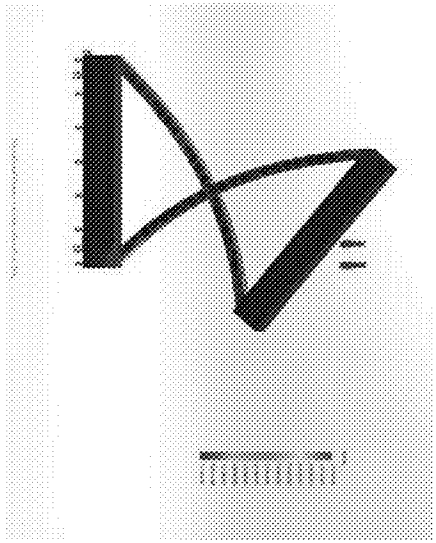

The inventors also provide FIGS. 20A-20B and 21A-21B, which depict the how BMGMC-based compliant mechanisms compare with steel-based compliant mechanisms for Cartwheel flexures and Crossblade flexures respectively. In particular, FIG. 20A depicts a cartwheel flexure made from steel, whereas FIG. 20B depicts a Cartwheel flexure made from a BMGMC. Note that the BMGMC is able to deflect to a greater extent under the same applied moment. Similarly. FIG. 21A depicts a crossblade flexure made from steel, and FIG. 21B depicts a crossblade flexure made from a BMGMC. Again, note that the BMGMC is able to deflect to a greater extent under the same applied load.

Note also that, in many instances, prior to fabricating a BMG-based macroscale compliant mechanism, a model of the compliant mechanism is manufactured from polymers using 3d-printing techniques. In this way, the efficacy of the design may be assessed before committing resources to fabricating the BMG-based part. This assessment can be particularly useful as polymers have similar strain characteristics of many BMGMCs—accordingly a 3d-printed polymer-based compliant mechanism can in many ways simulate the operation of the related BMG-based compliant mechanism. Moreover 3d-printing is generally more cost efficient as relative to the manufacturing techniques used in fabricating BMG-based compliant mechanisms.

Any of the above-mentioned manufacturing techniques can be implemented in accordance with embodiments of the invention. More generally, as can be inferred from the above discussion, the above-mentioned concepts can be implemented in a variety of arrangements in accordance with embodiments of the invention. Accordingly, although the present invention has been described in certain specific aspects, many additional modifications and variations would be apparent to those skilled in the art. It is therefore to be understood that the present invention may be practiced otherwise than specifically described. Thus, embodiments of the present invention should be considered in all respects as illustrative and not restrictive.

What claimed is:

1. A macroscale compliant mechanism comprising:

a flexible member that is strained during the operation of the compliant mechanism;

wherein the flexible member has a thickness of at least approximately 0.5 mm;

wherein the flexible member comprises a bulk metallic glass-based material; and wherein the bulk metallic glass-based material can survive a fatigue test that includes 1000 cycles under a bending loading mode at an applied stress to ultimate strength ratio of 0.25; and wherein the flexible member is configured such that its displacement-response to an applied force is nonlinear;

wherein the bulk metallic glass-based material is a bulk metallic glass matrix composite;

wherein the compliant mechanism is selected from the group consisting of a cutting device, a grasping device, a bistable mechanism, and a rotational hexfoil flexure; and wherein the cutting device comprises:

a bladed section with a first and second blade; and a handled section with a first and second handle;

wherein the cutting device is configured such that the rotation of the handles towards one another causes the rotation of the blades towards one another;

wherein the grasping device comprises:

a grasping section with a first and second grasping element; and a handled section with a first and second handle;

wherein the grasping device is configured such that the rotation of the handles towards one another causes the rotation of the grasping elements towards one another;

wherein the bistable mechanism is configured to be stable in two configurations; and wherein the rotational hexfoil flexure comprises:

a base cylindrical portion;

an overlaid cylindrical portion; and three beams;

wherein one end of each beam is adjoined to the base cylindrical portion, and the opposite end of each beam is adjoined to the overlaid cylindrical portion;

wherein the rotational hexfoil flexure is configured such that the base cylindrical portion and the overlaid cylindrical portion can be rotated relative to one another.

2. The bulk metallic glass-based macroscale compliant mechanism of claim 1, wherein the volume fraction of crystals within the bulk metallic glass matrix composite is between approximately 20% and 80%.

3. The bulk metallic glass-based macroscale compliant mechanism of claim 1, wherein the bulk metallic glass-based material has a yield strain greater than approximately 1.5%.

4. The bulk metallic glass-based macroscale compliant mechanism of claim 2, wherein the bulk metallic glass-based material has a strength to stiffness ratio greater than approximately 2.

5. The bulk metallic glass-based macroscale compliant mechanism of claim 1, wherein the bulk metallic glass-based material is one of: $Ti_{44.3}Zr_{20}V_{12}Cu_5Be_{15}$, $Zr_{39.6}Ti_{33.9}Nb_{7.6}Cu_{6.4}Be_{12.5}$, $Zr_{56.2}Ti_{13.8}Nb_{5.0}Cu_{6.9}Be_{12.5}$, $Ti_{31.4}Zr_{36.6}Nb_7Cu_{5.9}Be_{19.1}$, $Ti_{43}Zr_{25}Nb_7Cu_6Be_{19}$, and $Ti_{25}Zr_{43}Nb_7Cu_6Be_{19}$.

6. The bulk metallic glass-based macroscale compliant mechanism of claim 1, wherein the bulk metallic glass-based macroscale compliant mechanism is a TiZrBeXY alloy, wherein X is an additive that enhances glass forming ability and Y is an additive that enhances toughness.

7. The bulk metallic glass-based macroscale compliant mechanism of claim 6, wherein the bulk metallic glass-based material comprises:

Ti in an amount between approximately 10 and 60 atomic %;

Zr in an amount between approximately 18 and 60 atomic %; and

Be in an amount between approximately 7 and 30 atomic %.

8. The bulk metallic glass-based macroscale compliant mechanism of claim 7, wherein X is one of Fe, Cr, Co, Ni, Cu, Al, B, C, Ag, Si, and mixtures thereof.

9. The bulk metallic glass-based macroscale compliant mechanism of claim 7, wherein:

X is one of: C, Si, and B; and

X is present in an amount less than approximately 2 atomic %.

10. The bulk metallic glass-based macroscale compliant mechanism of claim 7, wherein:

X is one of: Cr, Co, and Fe; and

X is present in an amount less than approximately 7 atomic %.

11. The bulk metallic glass-based macroscale compliant mechanism of claim 7, wherein X is Al and is present in an amount less than approximately 7 atomic %.

12. The bulk metallic glass-based macroscale compliant mechanism of claim 7, wherein X is a combination of Cu and Ni, and is present in an amount less than approximately 20 atomic %.

13. The bulk metallic glass-based macroscale compliant mechanism of claim 7, wherein the combination of X and Be is present in an amount less than approximately 30 atomic %.

14. The bulk metallic glass-based macroscale compliant mechanism of claim 13, wherein Y is one of: V, Nb, Ta, Mo, Sn, W, and mixtures thereof.

15. The bulk metallic glass-based macroscale compliant mechanism of claim 14, wherein Y is V and is present in amount less than approximately 15 atomic %.

16. The bulk metallic glass-based macroscale compliant mechanism of claim 14, wherein Y is Nb and is present in an amount between approximately 5 and 15 atomic %.

17. The bulk metallic glass-based macroscale compliant mechanism of claim 14, wherein Y is Ta and is present in an amount less than approximately 10 atomic %.

18. The bulk metallic glass-based macroscale compliant mechanism of claim 14, wherein Y is Mo and is present in an amount less than approximately 5 atomic %.

19. The bulk metallic glass-based macroscale compliant mechanism of claim 14, wherein Y is Sn and is present in an amount less than approximately 2 atomic %.

20. The bulk metallic glass-based macroscale compliant mechanism of claim 1, wherein the bulk metallic glass-based material can survive a fatigue test that includes 1000 cycles under a bending loading mode at an applied stress to ultimate strength ratio of 0.4.

21. A bulk metallic glass-based macroscale compliant mechanism comprising:

a flexible member that is strained during the normal operation of the compliant mechanism;

wherein the flexible member has a thickness of 0.5 mm;

wherein the flexible member comprises a bulk metallic glass-based material; and wherein the bulk metallic glass-based material can survive a fatigue test that includes 1000 cycles under a bending loading mode at an applied stress to ultimate strength ratio of 0.25;

wherein the compliant mechanism is a cutting device comprising:

a bladed section with a first and second blade; and a handled section with a first and second handle;

wherein the cutting device is configured such that the rotation of the handles towards one another causes the rotation of the blades towards one another.

22. A bulk metallic glass-based macroscale compliant mechanism comprising:

a flexible member that is strained during the normal operation of the compliant mechanism;

wherein the flexible member has a thickness of 0.5 mm;

wherein the flexible member comprises a bulk metallic glass-based material; and wherein the bulk metallic glass-based material can survive a fatigue test that includes 1000 cycles under a bending loading mode at an applied stress to ultimate strength ratio of 0.25;

wherein the compliant mechanism is a grasping device comprising:

a grasping section with a first and second grasping element; and a handled section with a first and second handle;

wherein the grasping device is configured such that the rotation of the handles towards one another causes the rotation of the grasping elements towards one another.

23. A bulk metallic glass-based macroscale compliant mechanism comprising:

a flexible member that is strained during the normal operation of the compliant mechanism;

wherein the flexible member has a thickness of 0.5 mm;

wherein the flexible member comprises a bulk metallic glass-based material; and wherein the bulk metallic glass-based material can survive a fatigue test that includes 1000 cycles under a bending loading mode at an applied stress to ultimate strength ratio of 0.25;

wherein the compliant mechanism is a rotational hexfoil flexure comprising:

a base cylindrical portion;

an overlaid cylindrical portion; and three beams;

wherein one end of each beam is adjoined to the base cylindrical portion, and the opposite end of each beam is adjoined to the overlaid cylindrical portion;

wherein the rotational hexfoil flexure is configured such that the base cylindrical portion and the overlaid cylindrical portion can be rotated relative to one another.

* * * * *